US005292170A

United States Patent [19]

LaPointe et al.

[11] Patent Number: 5,292,170

[45] Date of Patent: Mar. 8, 1994

[54] RECLINER ASSIST APPARATUS

[75] Inventors: Larry P. LaPointe, Temperance; Karl J. Komorowski, Petersburg; Jonathan R. Saul, LaSalle, all of Mich.

[73] Assignee: La-Z-Boy Chair Co., Monroe, Mich.

[21] Appl. No.: 40,004

[22] Filed: Apr. 9, 1993

Related U.S. Application Data

[63] Continuation-in-part of Ser. No. 740,980, Aug. 6, 1991, Pat. No. 5,271,660.

[51] Int. Cl.[5] ..... A47C 1/02

[52] U.S. Cl. ..... 297/85; 297/68

[58] Field of Search ..... 297/83-85, 297/68-71, 87, 89, 423.26

[56] References Cited

U.S. PATENT DOCUMENTS

| | | | |
|---|---|---|---|
| 745,706 | 12/1903 | Wilsdorf | 297/434 X |
| 1,048,306 | 12/1912 | Greilick . | |
| 2,588,574 | 3/1952 | Rizzolo | 297/87 X |
| 2,677,412 | 5/1954 | Thomas . | |
| 2,918,110 | 12/1959 | Schliephacke . | |
| 2,918,111 | 12/1959 | Schliephacke . | |
| 2,919,745 | 1/1960 | Schliephacke . | |
| 3,014,758 | 12/1961 | Schliephacke | 297/89 |
| 3,033,611 | 5/1962 | Schliephacke . | |
| 3,096,121 | 7/1963 | Knabusch et al. . | |
| 3,099,487 | 7/1963 | Knabusch et al. | 297/429 |
| 3,400,975 | 9/1968 | Rogers, Jr. | 297/85 X |
| 3,537,747 | 11/1970 | Rogers, Jr. | 297/85 |
| 3,567,280 | 3/1971 | Bradshaw | 297/318 |
| 3,869,169 | 3/1975 | Johnson et al. | 297/84 |
| 3,869,170 | 3/1975 | James et al. | 297/270 |
| 3,869,172 | 3/1975 | James et al. | 297/316 |
| 3,874,724 | 4/1975 | Re | 297/88 |
| 4,071,275 | 1/1978 | Rogers et al. | 297/85 |
| 4,072,342 | 2/1978 | Johnson et al. | 297/84 |
| 4,179,157 | 12/1979 | Shoemaker et al. | 297/83 |
| 4,226,469 | 10/1980 | Rogers, Jr. et al. | 297/85 |
| 4,291,913 | 9/1981 | Kowalski | 297/89 |
| 4,332,417 | 6/1982 | Mizelle | 297/329 |
| 4,346,933 | 8/1982 | Jacobs | 297/89 |
| 4,350,387 | 9/1982 | Rogers, Jr. | 297/85 |
| 4,364,603 | 12/1982 | Johnson | 297/84 |
| 4,367,895 | 1/1983 | Pacitti et al. | 297/85 |
| 4,423,903 | 1/1984 | Gerth | 297/89 |
| 4,494,793 | 1/1985 | Rogers, Jr. | 297/85 |
| 4,506,926 | 3/1985 | Griggs, Jr. | 297/83 |
| 4,668,009 | 5/1987 | Talley et al. | 297/85 |
| 4,690,454 | 9/1987 | Mizelle | 297/85 X |
| 4,740,031 | 4/1988 | Rogers, Jr. | 297/85 |
| 4,844,536 | 7/1989 | Mizelle | 297/68 |
| 5,011,220 | 4/1991 | LaPointe | 297/89 |
| 5,056,862 | 10/1991 | May et al. | 297/68 X |
| 5,064,244 | 11/1991 | Sproule | 297/83 |

*Primary Examiner*—Kenneth J. Dorner
*Assistant Examiner*—Milton Nelson, Jr.
*Attorney, Agent, or Firm*—Harness, Dickey & Pierce

[57] ABSTRACT

A reclining modular seating section having a recliner assist apparatus for initiating reclining movement of the seating section and extending movement of a leg rest assembly thereof. The release assist apparatus includes an insert member fixedly secured to a drive rod of a recliner mechanism of the seating unit. A drive bracket is fixedly secured to the insert member and pivotally coupled to a L-shaped coupling bracket. The L-shaped coupling bracket is in turn coupled to a biasing spring which exerts a tensioning force to drive the drive bracket and drive rod, to thereby cause the seating section to assume a reclined position with its leg rest member in an extended position when the drive bracket reaches an over center position. A release assist bracket is disposed coaxially about the insert member and has an end thereof coupled to a handle member which is graspable by an occupant of the seating unit. By pulling on the handle member, the release assist bracket urges the drive bracket to an over center position, thereby enabling the biasing spring to continue driving the drive rod so as to extend a leg rest assembly and simultaneously recline a seatback portion of the seating unit.

14 Claims, 14 Drawing Sheets

14
16B
16A
106
106

14
16A
106
16B
18

16B
14
16A
106
18
106
18

20
17
16A
106
16B
106
18
18

20
17
16B
16A
106
106

20
17
16B
16A
106
18
106
18

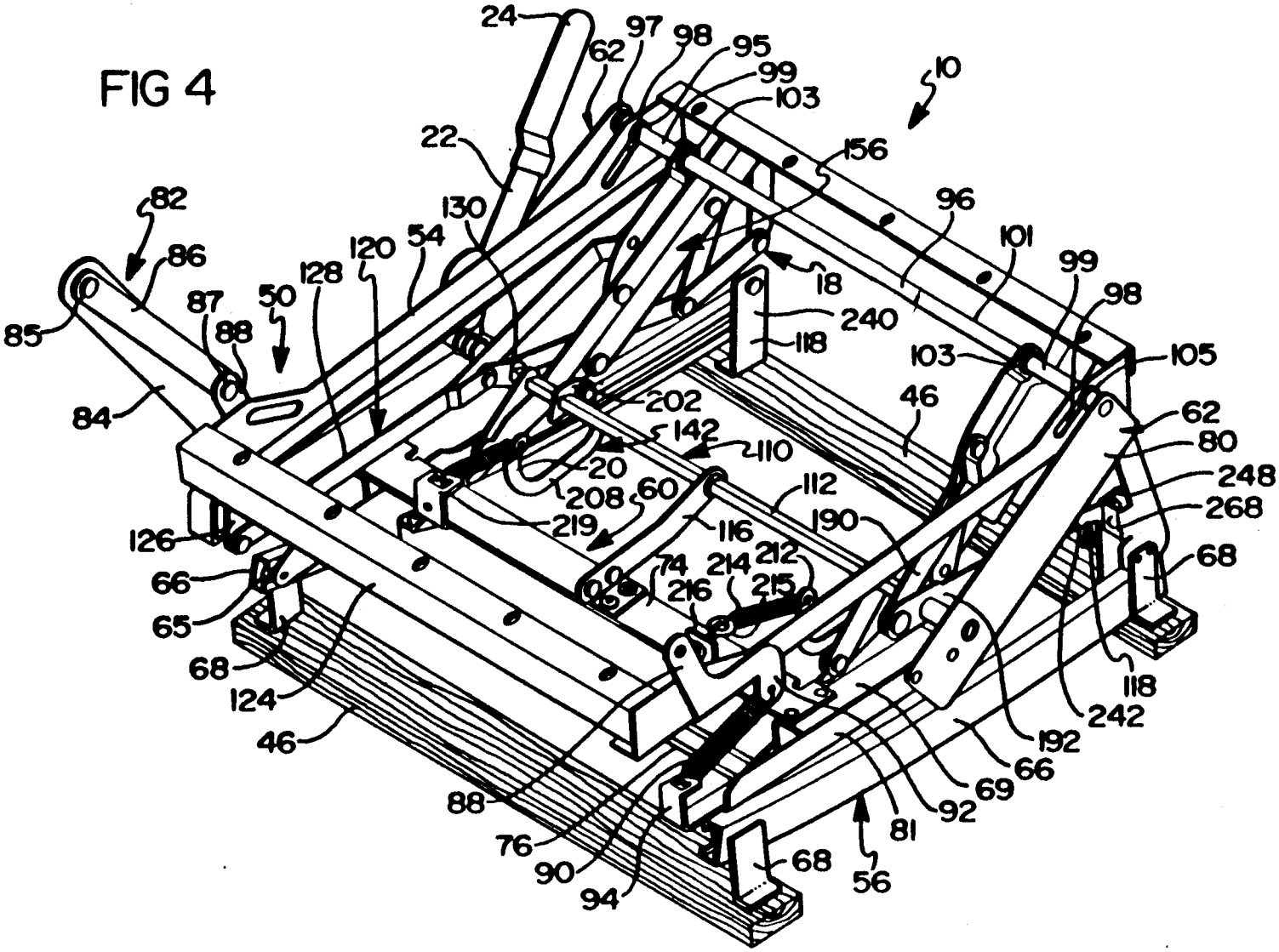
10
24
22
62
97
98
95
99
103
156
96
101
99
98
105
62
80
248
268
68
118
242
192
66
69
92
81
56
68
94
90
76
88
46
124
68
65
66
126
84
85
82
86
87
88
50
128
120
54
130
22
24

FIG 17
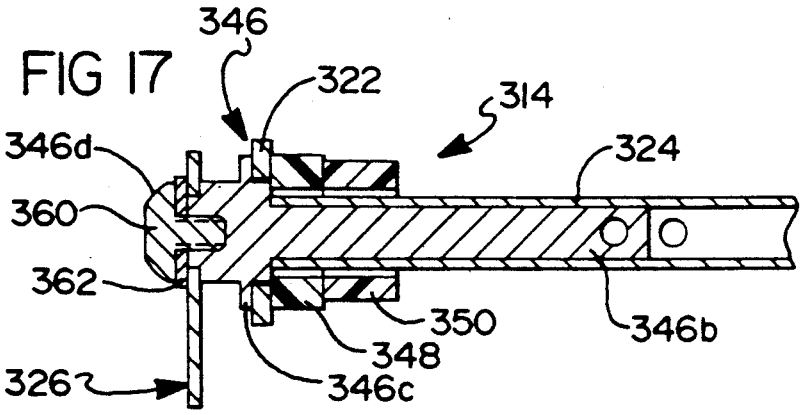
FIG 18
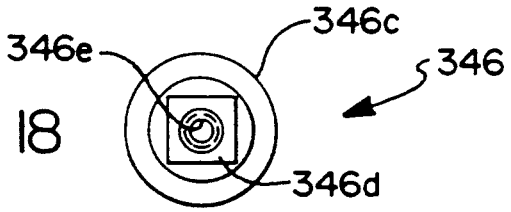
FIG 22
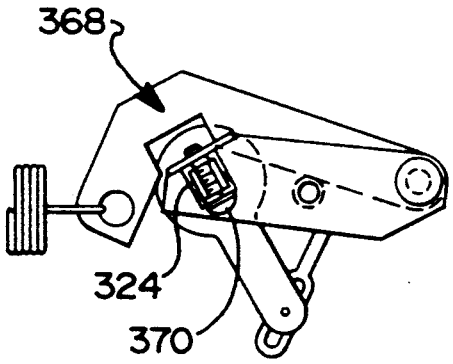
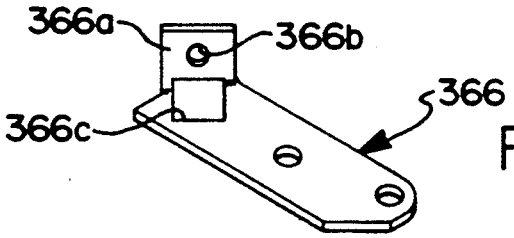
FIG 23

FIG 19
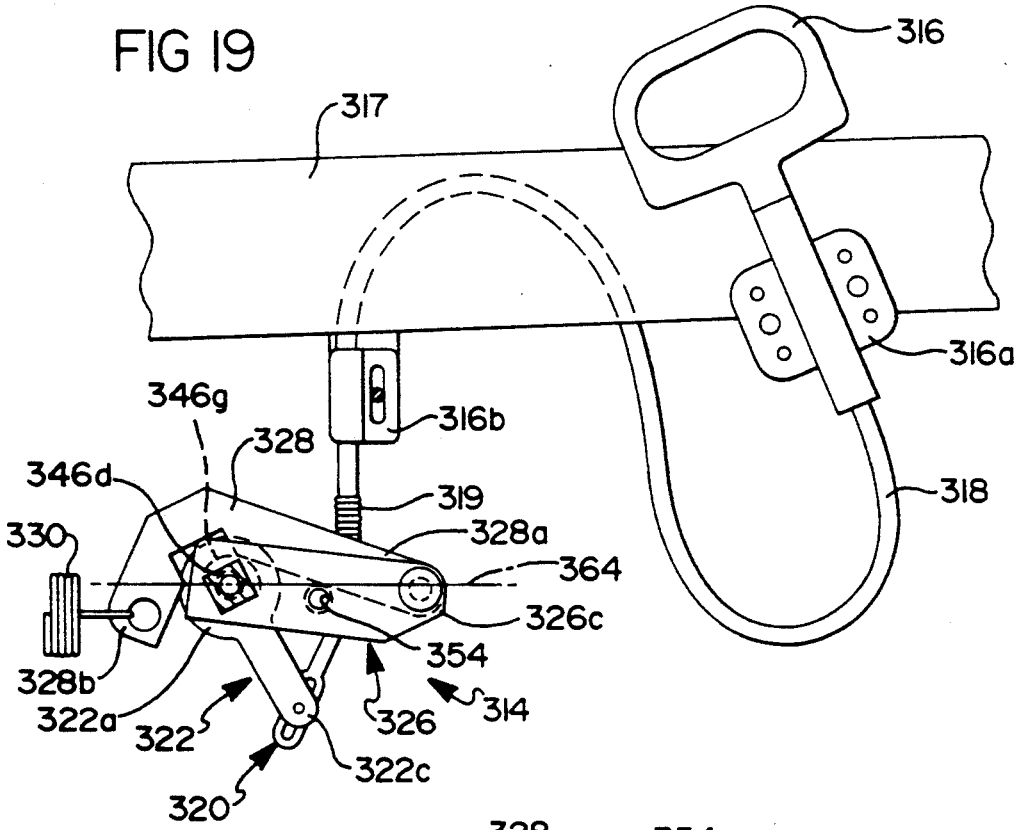
FIG 20
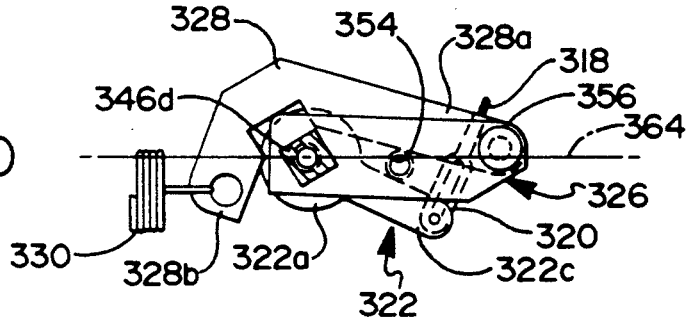
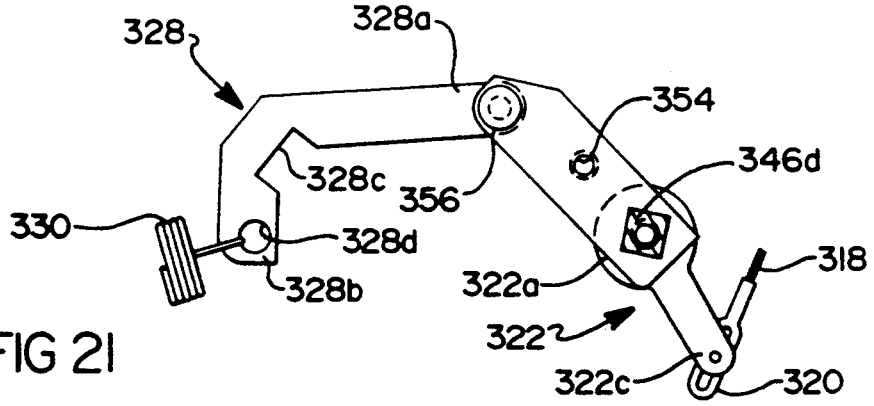
FIG 21

RECLINER ASSIST APPARATUS

CROSS-REFERENCE TO RELATED APPLICATIONS

This is a continuation-in-part of U.S. patent application Ser. No. 07/740,980, filed Aug. 6, 1991, now U.S. Pat. No. 5,271,660, and entitled "Reclining Sofa".

BACKGROUND OF THE INVENTION

The present invention relates to furniture and, more particularly, to an improved recliner assist apparatus for articles of furniture such as chairs, sofas and loveseats.

Conventionally, recliner type seating units (i.e. chairs, sofas, loveseats and the like), generally require a predetermined distance between an adjacent wall surface and the seatback to avoid contact therebetween during reclined operation. In addition, loose seat cushions are not generally used in most recliner type seating units due to the height requirements associated with operably supporting the mechanical recliner mechanism under the seat.

Reclining mechanisms typically generate a relatively large amount of frictional drag which must be overcome for smooth movement between an "upright" and a "tilted" position. In particular, lighter weight seat occupants must normally exert a deliberate leveraged thrust or force, in addition to pulling the actuator lever, for completely extending the leg rest and moving the seat section to its "tilted" position. Moreover, it is often difficult for the seat occupant to return to the upright position from the "tilted" or a fully "reclined" position due to the height and the upward angular tilt of the seat relative to the reclined seatback. As such, the occupant must exert a relatively large and deliberate leveraged force to return the reclined seat section to the full upright position. Another drawback associated with recliners is that the leg rest assembly cannot be retracted to its stowed position from an extended elevated position until after the seat occupant has completely returned the seat section to its full upright position.

As is known, virtually all traditional recliner type seating units require the seat occupant to either forcibly urge a portion of the seating section forwardly (i.e. by pulling on an arm portion of the chair), or manually move some type of actuating lever to initiate movement of the leg rest assembly from a retracted position toward an extended and elevated position. While most recliner type seating units have proven to be generally successful, it nevertheless would be desirable to permit the seat occupant to deliberately initiate movement of the leg rest assembly toward its extended position with virtually no physical effort. Such a leg rest release arrangement would be particularly advantageous for elderly or handicapped persons who typically have difficulty, because of lack of strength, in using conventional release means (i.e. movement of levers or gripping an arm portion of a recliner chair) to initiate the extending action of a leg rest assembly and/or tilting action of the seat assembly.

The above described traditional means for initiating reclining movement present additional problems when used with a seating section intended for use in a modular seating unit such as a modular sofa. If the seating section is not one of the corner sections but rather a center section of the seating unit, the seating unit is disposed between outer seating sections thus preventing the use of any graspable lever member on the side of the seating section. Since the center seating section has no arms, the occupant cannot initiate extension of a leg rest member thereof by simply pushing on the arm members. Accordingly, the use of center seating sections having extendable leg rests present particular problems with regard to initiating extending movement of the leg rest assembly conveniently and with a minimum amount of effort on the part of the occupant.

SUMMARY OF THE INVENTION

In accordance with the principles of the present invention, an improved reclining type article of furniture is disclosed incorporating a recliner assist apparatus which is designed to overcome various disadvantages associated with prior art recliners.

Accordingly, it is a basic purpose of the present invention to provide a recliner mechanism which permits the chair, sofa or loveseat to be placed directly against an adjacent wall surface without the necessity of providing a space therebetween. As such, the present invention is a "zero wall proximity" recliner mechanism which is fully reclinable within the confines of its stationary frame assembly.

It is an additional object of the present invention to provide a compact three-way recliner which permits use of loose cushions therewith. The "three-way" recliner provides operative linkages for "tilting" the seat unit, "reclining" the seatback relative to the seat frame and for extending and retracting the leg rest assembly.

It is another object of the present invention to reduce the input force exerted by the operator for smoother operation of the reclining mechanism. As a related object, the improved recliner mechanism has incorporated various linkage and drive components designed for substantially reducing frictional losses in an effort to promote easier actuation. Furthermore, the retracting movement of the leg rest assembly is utilized to assist in completely returning the seat unit to the "upright" position.

It is also a purpose of this invention to provide a reclining seat unit wherein the weight of the person occupying the seat unit is utilized as means to assist in moving a seat assembly from the "upright" position to the "tilted" and/or "reclined" positions and, while concurrently acting to assist in moving the leg rest assembly from a stored position to an elevated and operative position.

Another purpose of the invention is to provide a short-stroke drive assembly having an actuator lever, concealed in the upholstery, which may be easily operated by the seat occupant to concurrently operate the leg rest assembly and generate "tilting" movement of the seat assembly. In a preferred embodiment of the present invention, a sofa or loveseat has a leg rest assembly which is operated by the seat occupant rotating the actuator lever through a limited angle which, in turn, rotates a drive rod assembly for actuating the leg rest linkage. An over-center toggle mechanism is provided to assist in extending and retracting the leg rest assembly and in retaining the leg rest assembly in its "stowed" position. In addition, the drive rod assembly concurrently operates a drive linkage mechanism for "tilting" the seat unit relative to a stationary base assembly. Moreover, the included angle between the seatback and seat frame of the seat assembly remains substantially constant throughout the "tilting" movement. Following the "tilting" movement, the seat assembly can be additionally "reclined" by applying pressure to the seatback for increasing the included angle between the seatback and the seat frame. Therefore, "tilting" and "reclining" of the seat unit are independent of each other and are generally cumulative to define a "fully" reclined position.

In accordance with the present invention, forward movement of the seat unit relative to the base assembly is required prior to "reclining" movement of the seatback to compensate for rearward movement of the seatback so as to maintain a substantially constant clearance between the seatback of the seat unit and the adjacent wall surface. Furthermore, the "reclining" movement is easily initiated by the seat occupant by simply leaning his body to apply or remove pressure from the seatback. Due to the reduced frictional drag of the improved recliner mechanism, it is not necessary for the seat occupant to apply additional leverage with his arms or feet following sufficient rotation of the concealed actuator lever to continue the desired movement. In addition, "tilting" of the sofa or loveseat in conjunction with concurrent actuation of the leg rest assembly contributes significantly to the ease and smoothness of operation and also provides an added increment of comfort and consumer satisfaction.

It is a principal object of the present invention to provide a recliner assist apparatus which is well adapted for use with modular armless reclining seating sections intended to be positioned between one or more corner seating sections, to thus enable an occupant to easily initiate reclining movement of the seating section by simply manually engaging a portion of the release assist apparatus readily accessible to the occupant while the occupant is seated in the seating section.

It is yet another object of the present invention to provide a recliner assist apparatus which can be quickly and easily retrofitted to a wide variety of recliner mechanisms which allows a seat occupant to initiate reclining movement of the recliner mechanism without the need to push on an arm portion of the chair, and without the need to rotate a lever or other like component disposed on the side of the chair.

A further object of the present invention is to provide means by which the relative ease of moving the leg rest assembly between its retracted and extended positions, as well as the angle of inclination of the leg rest frame board may be independently and selectively adjusted. Thus, seat occupants of various sizes and having differing amounts of strength would be able to adjust not only the angle or "cant" of the leg rest frame board, but also the amount of spring-biased "assist" that is provided during extension and retracting movements.

The present invention is directed to an armless modular seating section for a modular sofa, where the modular seating section has a recliner assist apparatus by which the initial movement of the leg rest assembly toward the extended position may be easily initiated without significant effort by the seat occupant.

In a preferred embodiment of the invention, the assist apparatus comprises a recliner assist apparatus which is operable to initiate extending movement of the leg rest assembly and/or forward movement of the seat assembly to its tilted position upon the seat occupant merely pulling slightly on a graspable handle member positioned adjacent a seat member of the seating section. Accordingly, only minimal effort by the seat occupant is required to initiate extending movement of the leg rest assembly, and without the need for a lever member positioned on the side of the seating section or arm portions to push on.

DESCRIPTION OF THE DRAWINGS

Additional objects, advantages, and features of the present invention will become apparent to those skilled in the art from careful consideration of the following written description and appended claims, taken in conjunction with the accompanying drawings wherein:

FIG. 4 is a perspective view with upholstery, springs, and other various parts removed, and which is partially disassembled for clarity, of the improved recliner mechanism adapted to be within the frame assembly of FIG. 3;

FIG. 17 a side cross sectional view of the insert member of the recliner assist apparatus in accordance with section line 17—17 14;

FIG. 18 is an end elevational view of the insert member shown in FIG. 16;

FIG. 19 is an assembly view of the recliner assist apparatus showing the apparatus in a first or a locked position it assumes when a leg rest assembly of the recliner mechanism is fully retracted;

FIG. 20 is a view of the recliner assist apparatus of FIG. 19 showing the apparatus in a position just over center at the instant just before the biasing spring causes the drive rod to be rapidly driven rotationally to extend the leg rest assembly and to cause reclining movement of the seatback portion of the chair;

FIG. 21 is a view of the recliner assist apparatus of FIG. 20 showing the apparatus in a resting position after the biasing spring has caused the drive rod to be rotationally driven to completely extend the leg rest assembly;

FIG. 22 is a side elevational view of an alternative preferred embodiment of the drive bracket of the apparatus showing the drive bracket coupled to the drive rod via a conventional threaded screw; and FIG. 23 is an elevational view of the bracket of FIG. 22 showing more clearly the transversely extending corner portion thereof.

DETAILED DESCRIPTION OF THE INVENTION

In accordance with the teachings of the present invention, an improved reclining mechanism for use in single person (i.e., chairs) and multi-person (i.e., sofas and loveseats) articles of furniture is disclosed. As will be described in greater detail, the improved recliner mechanism is a "wall hugger" type or a "zero wall proximity" recliner unit. More particularly, the improved recliner mechanism is designed to travel within the confines of its stationary frame assembly for substantially flush mounting against an adjacent wall surface while permitting full reclining operation.

The recliner mechanism of the present invention is a "three-way" mechanism which can be independently "tilted", "reclined", and have its leg rest assembly operably retracted or extended. When a person sits in a loveseat or sofa equipped with the improved recliner mechanism, the leg rest assembly is extended by selectively rotating an actuator lever which is concealed in the sofa between an outer edge of the seat cushion and the inside arm. In addition, substantially concurrent "tilting" movement of the seat unit is provided upon such rotation of the actuator lever. Thereafter, independent "reclining" movement of the seatback relative to the seat is possible when the seat unit is in the "tilted" position. The recliner mechanism of the present invention is relatively compact in size to permit use of loose upholstered cushions which are modernly essential for marketing all styles of sofa or loveseat furniture.

Figures 1A, 1B, 1C, 2A, 2B, 2C:
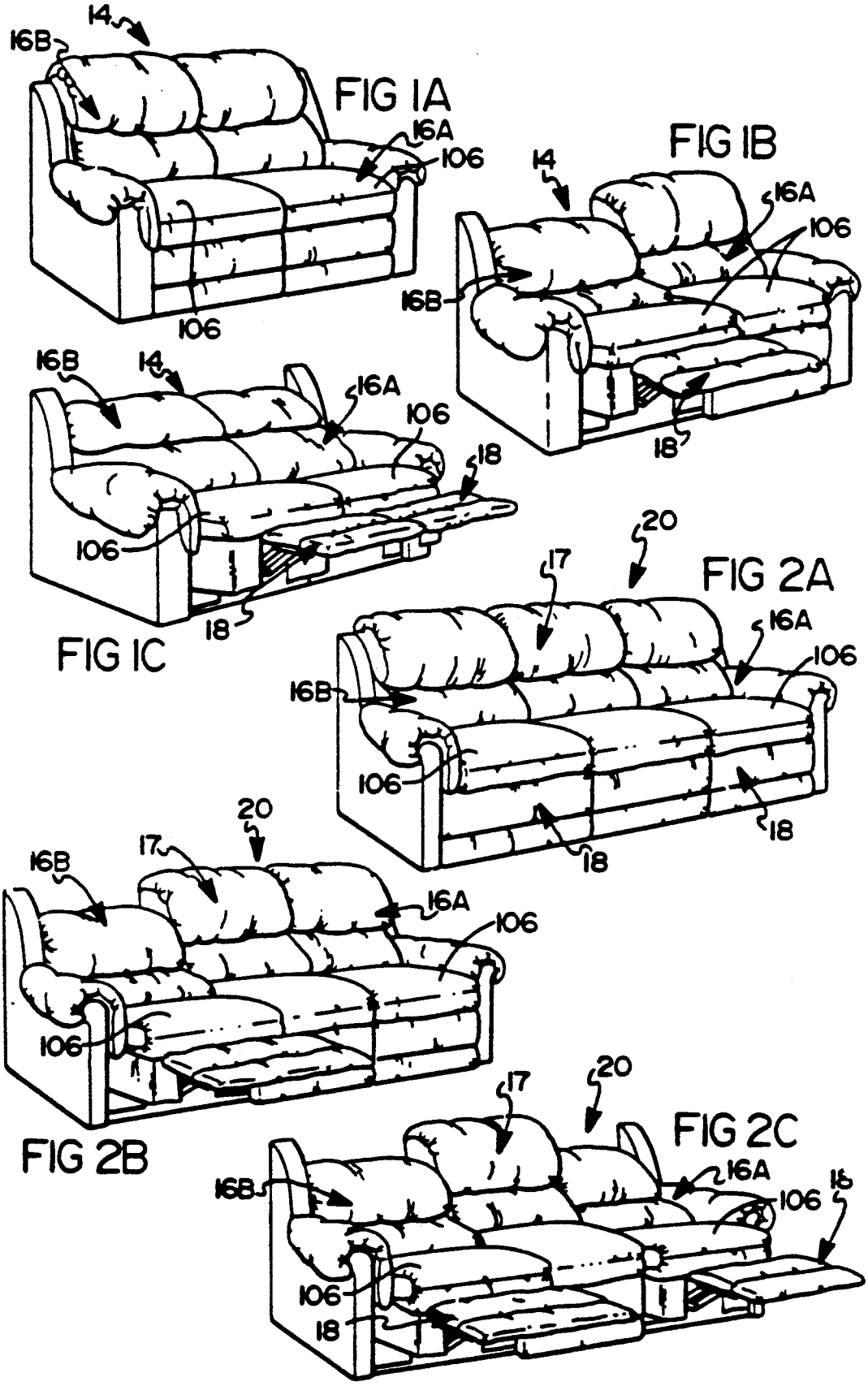
FIGS. 1A through 1C are perspective views of an exemplary upholstered "loveseat" having right and left reclining seat units embodying the present invention and which are shown in various upright and reclined positions.
FIGS. 2A through 2C are perspective views of an exemplary upholstered "sofa" having left and right recliner seat units embodying the present invention and which are shown in various upright and positions.

With particular references to the drawings, the operative relationship of an improved recliner mechanism 10 of the type adapted to be supported within a frame assembly 12 will now be described in greater detail. More particularly, FIG. 1A shows an exemplary loveseat 14 having right and left upholstered and reclinable seat units 16A and 16B, respectively, both of which are in their "upright" position. FIG. 1B illustrates left seat unit **16*b* reclined with its associated leg rest assembly 18 being protracted to an elevated position. FIG. 1C depicts reclined operation of both seat units 16*a* and 16*b* and their respective leg rest assemblies 18. Similarly, an exemplary sofa 20 is shown in FIGS. 2A through 2C having right and left upholstered and reclinable seat units 16*a* and 16*b***, respectively, in various combinations of upright and reclined positions.

FIG. 4 is a perspective view of a right side recliner mechanism 10, with upholstery, padding, springs, etc. removed, which is adapted for use with right seat units **16*a* of loveseat 14 and sofa 20. It will be appreciated that the recliner mechanism to be used for left seat units 16*b* is substantially a mirror-image of that shown in FIG. 4. Moreover, the recliner mechanisms associated with seat units 16*a* and 16*b* each have a concealed actuator lever 22 with a handle portion 24 provided adjacent an arm portion of the sofa or loveseat that can be easily reached by a person seated in the seating unit for convenient actuation of recliner mechanism 10. However, it will be appreciated that other suitable manually operable release mechanism known in the art, such as a push-button cable release or an exterior mounted actuator lever, can be readily incorporated into the improved recliner mechanism of the present invention. Likewise, it is to be understood that while the preferred embodiments reflect incorporation of improved recliner mechanism 10 in sofas and loveseats, recliner mechanism 10** is likewise readily adaptable for use in other articles of furniture such as chairs, modular components, and the like.

Figure 3:
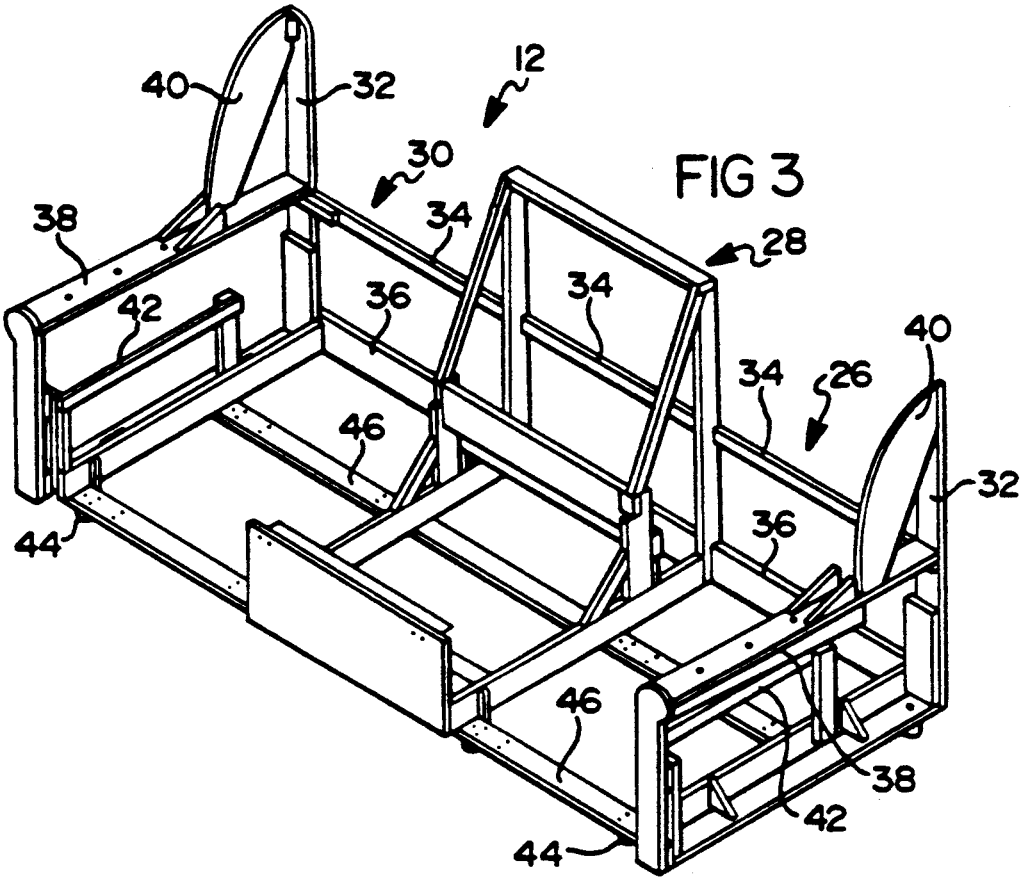
FIG. 3 is a perspective view of a frame assembly (with upholstery removed) for the sofa unit of FIGS. 2A through 2C and which is adapted to receive the improved reclining mechanism of the present invention therein.

With particular reference to FIG. 3, a stationary frame assembly 12 for sofa 20 is shown which is configured to support and retain left and right recliner mechanisms 10 therein.

Frame assembly 12 defines three (3) frame sections 26, 28 and 30. Central frame section 28 is adapted to support a non-reclinable seat unit 17 thereon while outer sections 26 and 30 support seat units **16*a* and 16*b*, respectively. As will be appreciated, loveseat 14 would have a frame assembly that is substantially similar to frame assembly 12 except that center section 28 would be removed. Frame assembly 12** is preferably made of numerous wood rails that are fixedly secured together by suitable fasteners, such as dowels, staples, nails and screws, and which may be reinforced at critical joints by metal reinforcement plates or brackets and/or wood corner blocks in a known manner.

Frame assembly 12 has left and right vertical rear corner posts 32 and reinforcing rails 34 extending therebetween which are affixed to posts 32. Similarly, rear bottom rails 36 extend between and are affixed to a lower portion of posts 32. Frame sections 26 and 30 each include arm rails 38 which extend traversely to and are supported from posts 32. A diagonal brace piece 40 is used between arm rails 38 and an upper portion of vertical posts 32. Left and right lower inner side rails 42 define an inner edge for locating recliner mechanisms 10 thereon. A suitable leg assembly 44 may be affixed to the bottom of spaced bottom rails 46. Left and right recliner mechanisms constructed according to the present invention are adapted to be fixedly secured to a top surface of bottom rails 46 for full reclining operation within the confines of frame sections 26 and 30. Again, it is to be noted that the recliner mechanism mounted in left frame section 30 would be a left hand version (i.e., mirror-image) of the recliner mechanism 10 illustrated. While a specific frame assembly is described, it is to be understood that it is merely exemplary for purposes of illustration only.

With particular reference now to FIGS. 4 through 11, the various components of improved recliner mechanism 10 will be described in greater detail. In general, recliner mechanism 10 is provided to produce independent "tilting" and "reclining" movement of a seat assembly 50 within frame assembly 12 and selective operation of leg rest assemblies 18. Seat assembly 50 includes a seatback 52 and a seat frame 54 each of which is constructed in a manner that enables them to support springs, padding upholstery, etc. in order to complete a stylish and comfortable sofa or loveseat.

For purposes of clarity, the term "tilting" refers to angular movement of seat unit 16 and, in turn, seat assembly 50 relative to a stationary base assembly 56 mounted to bottom rails 46 of frame assembly 12. Recliner mechanism 10 is designed such that during "tilting" movement, a relatively constant included angle "A" between seatback 52 and seat frame 54 is maintained. Such "tilting" movement occurs substantially concurrently with protraction of leg rest assembly 18 via sufficient rotation of actuator lever 22 by the seat occupant. Likewise, return of seat unit 16 to the "upright" position occurs concurrently with return of leg rest assembly 18 to it "stowed" position. The term "reclining" refers to the relative angular movement of seatback 52 with respect to seat frame 54 for increasing the included angle to a maximum "B" therebetween. Generally, no significant "reclining" movement is possible when seating units 16 is in its normal "upright" position. However, following "tilted" movement of seat assembly 50 relative to base assembly 56, a predetermined range of additional "reclining" movement is possible for approaching a reclined position similar to a bed (i.e., a "fully" reclined position). Moreover, the present invention is designed to permit infinite adjustment of the desired reclined position within the range of reclining movement between the included angles "A" and "B".

Figure 7:
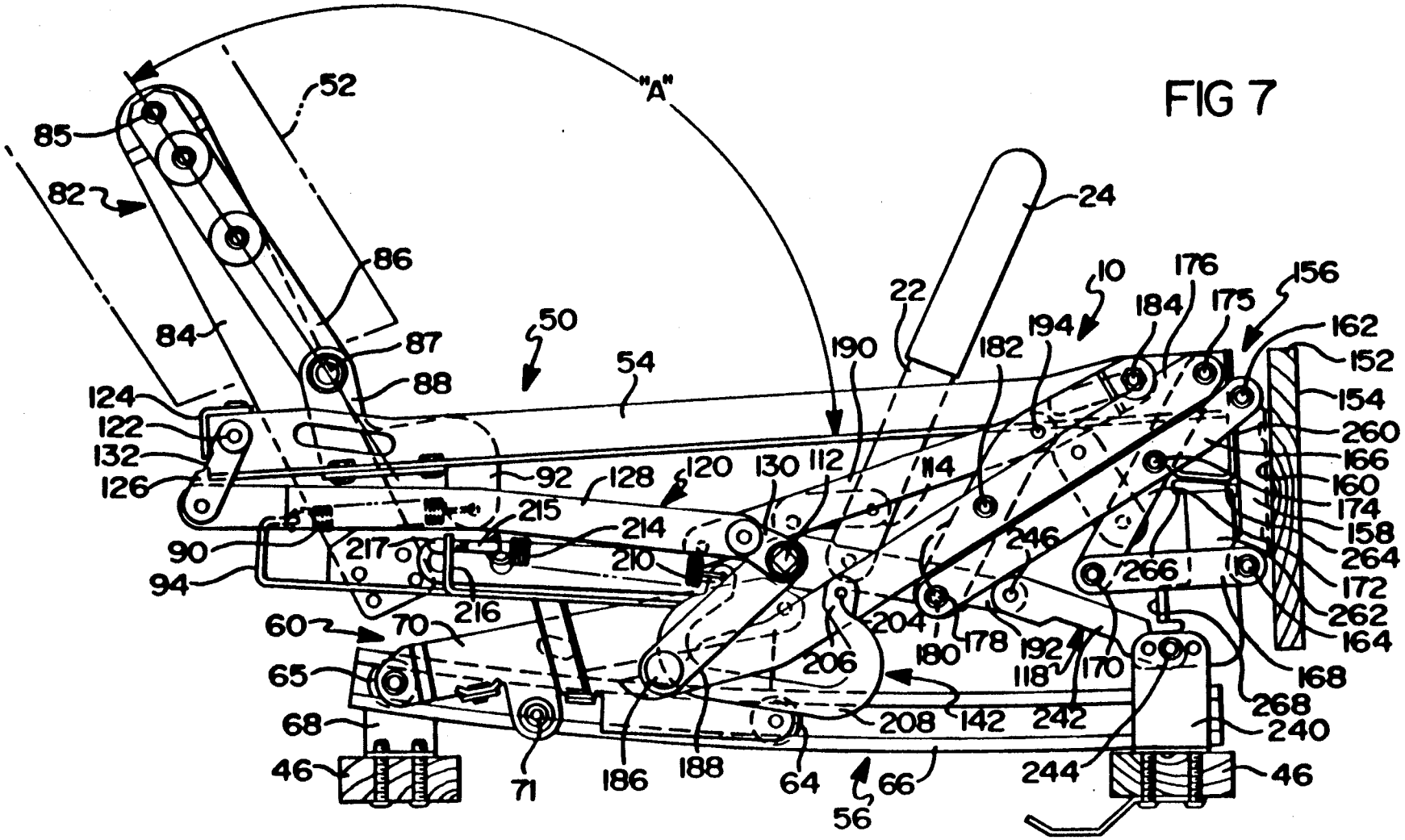
FIG. 7 is a view taken along line 7—7 of FIG. 6 illustrating the recliner mechanism in an "upright" position.
Figure 8:
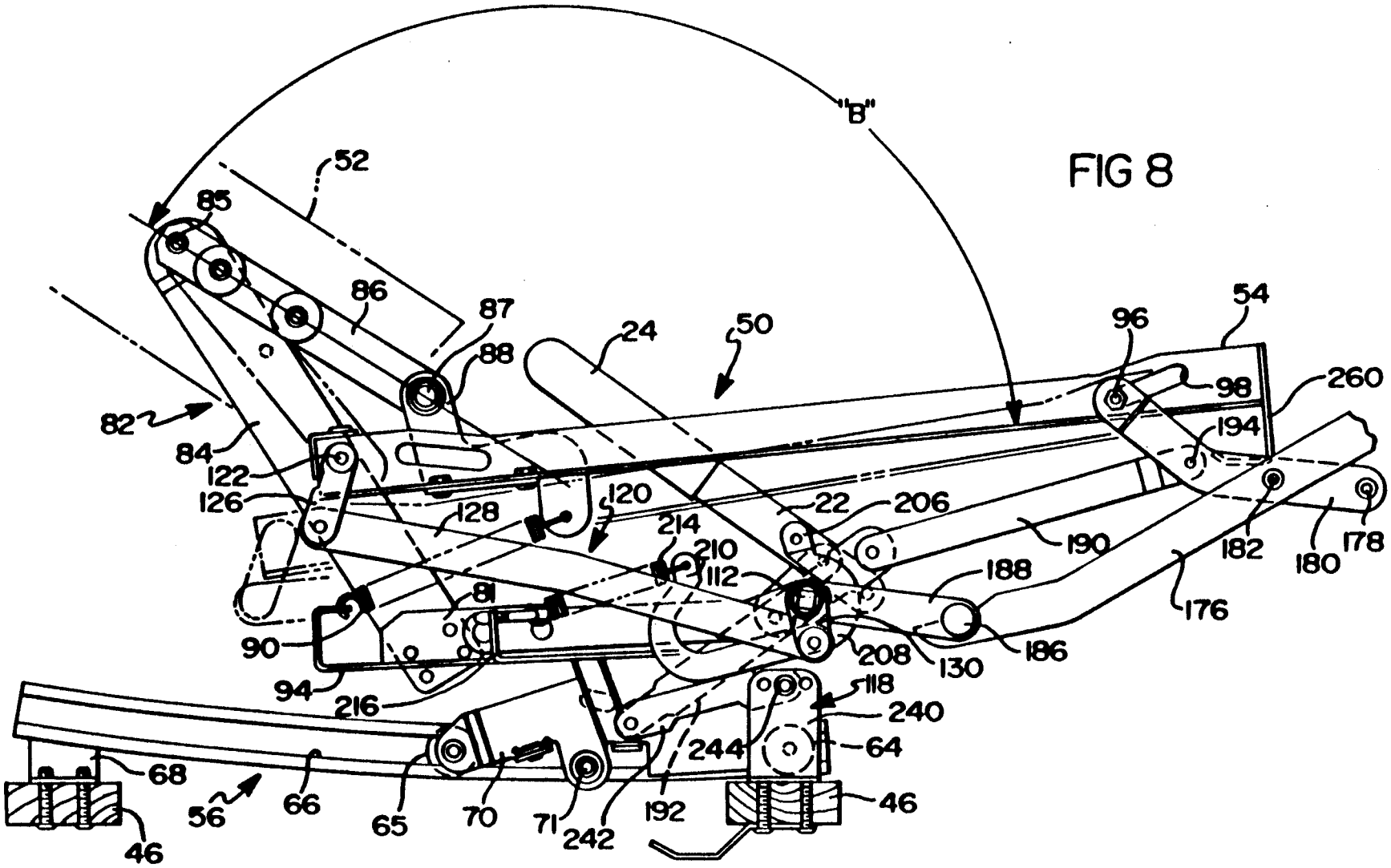
FIG. 8 is a view similar to FIG. 7 illustrating the leg rest assembly in an extended position and the seat assembly in a "tilted" (in and a fully "reclined" position.

FIG. 7 illustrates the operative relationship of seat assembly 50 and leg rest assembly 18 in their respective rear "upright" and "stowed" positions in which an occupant may enjoy conventional seating. FIG. 8 illustrates seat assembly 50 of recliner mechanism 10 in a forward fully "reclined" position and a "tilted" position (phantom lines). Likewise, leg rest assembly 18 is shown in its extended operative position. Upon rotation of actuator lever 22, seat assembly 50 is rearwardly "tilted" relative to a horizontal axis upon forward longitudinal movement on base assembly 56 to the position shown. In this "tilted" position, application of deliberate pressure by the occupant on seatback 52 permits the additional range of "reclining" movement. In this "fully" reclined position, the included angle "B" between seatback 52 and seat frame 54 is at its maximum level.

With particular reference to FIG. 4, the primary components of recliner mechanism 10 which produces the above-noted movement characteristics will now be described. Recliner mechanism 10 includes a wheeled carriage assembly 60 upon which mirror-image left and right side rail assemblies 62 are securely affixed for supporting seat assembly 50 therebetween. Carriage assembly 60 is supported for longitudinal fore and aft movement on stationary base assembly 56 for generating the "tilting" movement of seat assembly 50. More particularly, when carriage assembly 60 is released to move forward relative to base assembly 56, seat assembly 50 tilts to the "tilted" position. Likewise, rearward movement of carriage assembly 60 returns seat assembly 50 to the normal upright position.

Figure 9:
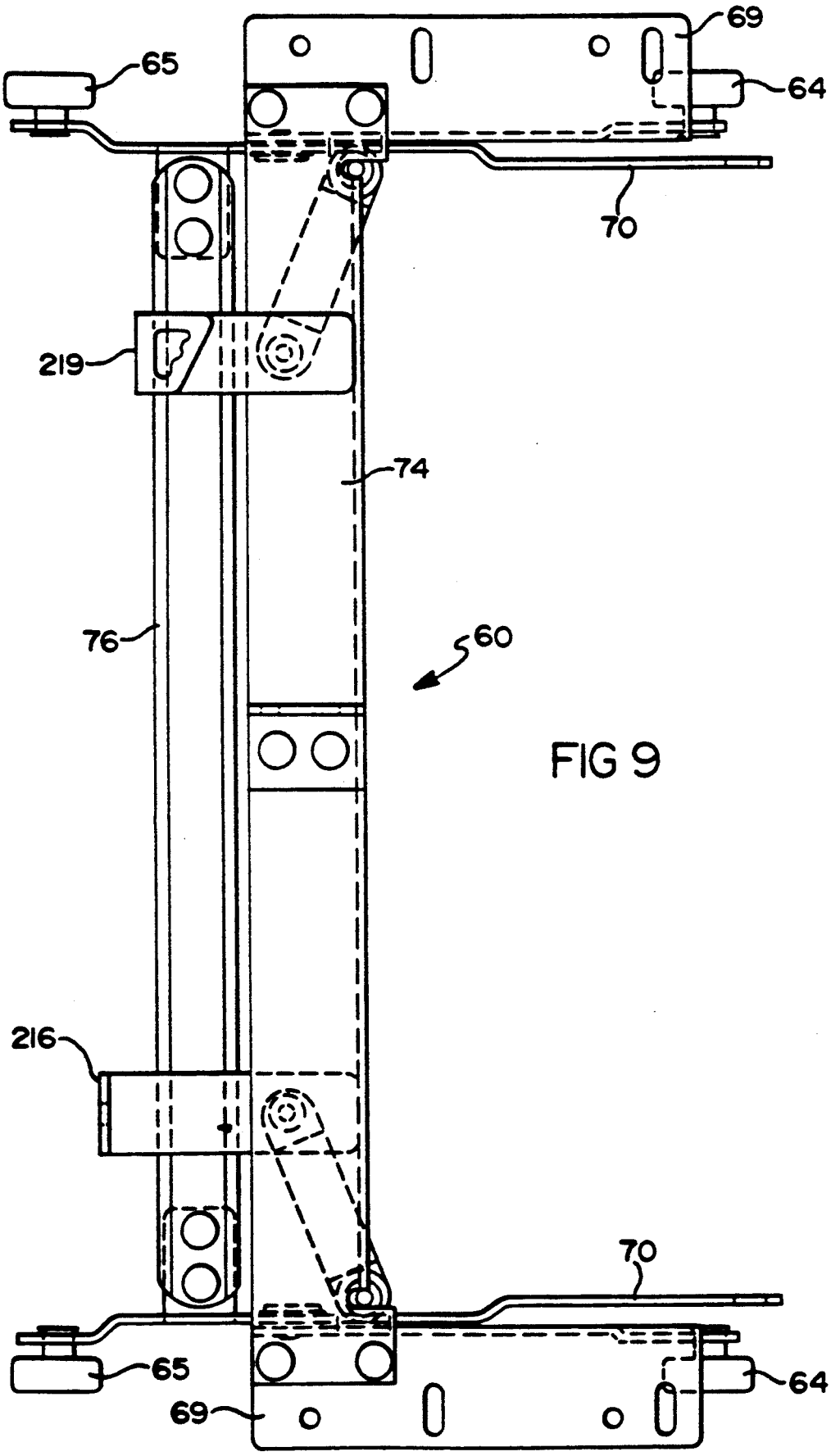
FIG. 9 is an enlarged plan view of the wheel carriage assembly of the present invention.
Figure 10:
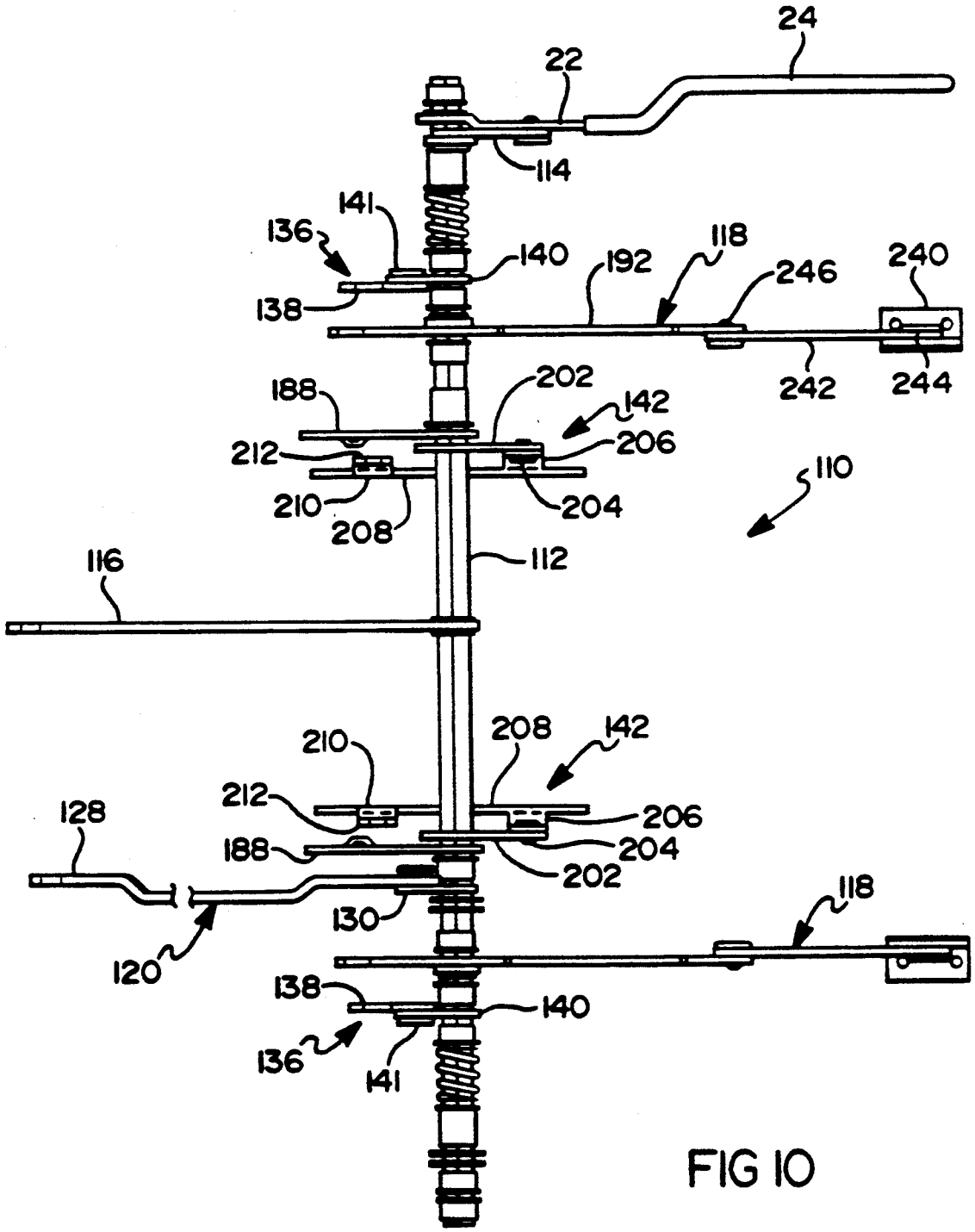
FIG. 10 is a plan view of the drive rod assembly incorporated within the improved recliner mechanism of the present invention.

Carriage assembly 60 is a rigid support structure having wheeled units 64 disposed for rolling movement in left and right tracks 66 of base assembly 56. Tracks 66 are aligned in parallel facing relation and are channel-shaped rectangular members which are preferably, downwardly curved from back to front to generate a gravity-assisted "down-hill" rolling movement of wheel units 64 therein Tracks 66 are rigidly secured at opposite terminal ends via left and right angled brackets 68 to bottom rails 46 of frame assembly 12. With reference to FIG. 9, carriage assembly 60 is shown to include left and right angled brackets 69 each having a first wheel unit 64 secured to an outer forward portion thereof. Left and right pivot levers 70 are affixed to left and right angled brackets 69, respectively, for pivotable movement about pivot 71 and include a second wheel unit 65 at their rear-most end. The opposite end of pivot levers 70 is secured to its respective left and right "tilt linkages", the structure and operation of which will be described hereinafter. Extending transversely between left and right angled brackets 69 is an upper reinforcement rail 74. Similarly, transversely extending between left and right pivot levers 70 is a lower reinforcement rail 76. These reinforcement rails 74 and 76 provide structural rigidity to carriage assembly 60.

Left and right side rail assemblies 62 are affixed to carriage assembly 60 for supporting seat assembly 50 therebetween during "tilting" movement of seat assembly 50 upon forward movement of carriage assembly 60 on base assembly 56. In addition, side rail assemblies 62 pivotably interconnect seatback 52 and seat frame 54 for permitting independent "reclining" movement therebetween following "tilted" movement. Each side rail assembly 62 includes a seat plate 80 fixedly secured to a side plate bracket 81 which is, in turn, secured to its respective angled bracket 69 of carriage assembly 60. Left and right seat swing assemblies 82 are provided for pivotally coupling seatback 52 to seat frame 54 for "reclining" movement therebetween.

Seat swing assemblies 82 each include a generally rearwardly upstanding back member 84 having a lower end secured to a rearward end of its respective side plate bracket 81. The upper end of back members 84 are pivotally coupled at pivot 85 to a first end of swing members 86 upon which seatback 52 is mounted in a conventional manner. The opposite end of left and right swing members 86 are pivotally connected at pivots 87 to left and right seat brackets 88 which are, in turn, securely mounted to left and right frame rails of seat frame 54. Left and right extension springs 90 are attached between forward extensions 92 on seat brackets 88 which extend below seat frame 54 and rearwardly extending extension brackets 94 secured to angled carriage brackets 69. As such, seat assembly 50 is normally biased in a direction to maintain the normal included angle "A" between seat frame 54 and seatback 52 regardless of its "upright" or "tilted" relation to base assembly 56. Extension brackets 94 are provided with a plurality of stepped surfaces to which springs 90 can be selectively attached to permit adjustment of the spring biasing force acting on seat assembly 50.

A front support shaft 96 extends through lost-motion slots 98 formed in the left and right frame rails of seat frame 54 and is connected at its opposite ends to an upper end of left and right seat plates 80. The length of slots 98 define the range of forward movement of seat frame 54 relative to side rail assemblies 62 upon the seat occupant applying a force to "recline" seatback 52 (see FIGS. 7 and 8). In addition, friction means are provided for generating slight frictional drag upon movement of support shaft 96 within slots 98. In particular, nylon washers 95 coaxially supported on shaft 96 on opposite sides of slots 98, are biased to generate sufficient frictional drag to coact with extension springs 90 for permitting infinite reclining adjustment of seat assembly 50 between non-reclined included angle "A" and fully reclined included angle "B". Such interaction between springs 90 and the friction means also produces stable and smooth reclining movement which is not overly-sensitive to small amounts of movement by the seat occupant.

Figure 5:
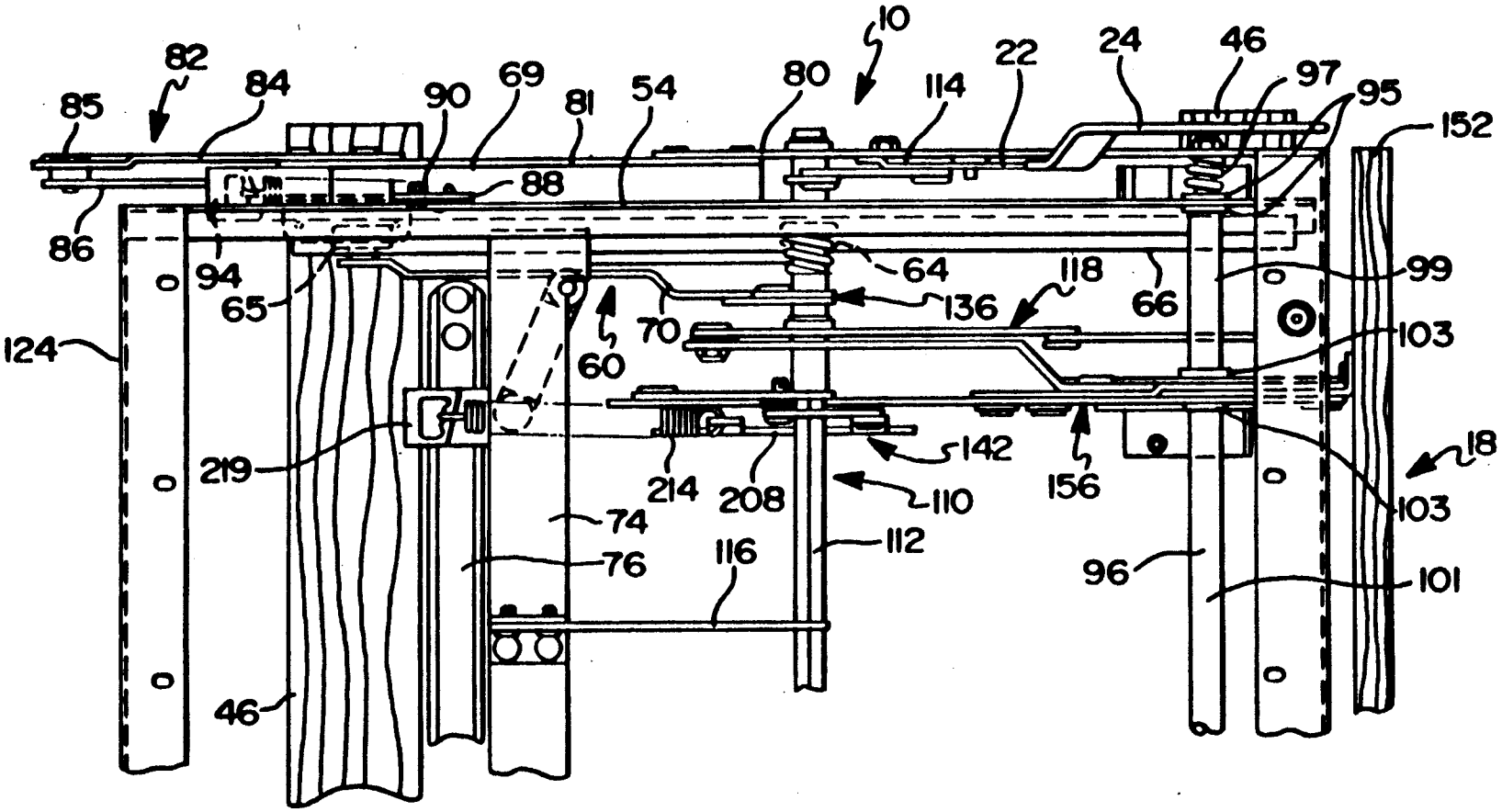
FIG. 5 is a plan view of the left half portion of the recliner mechanism 4.
Figure 6:
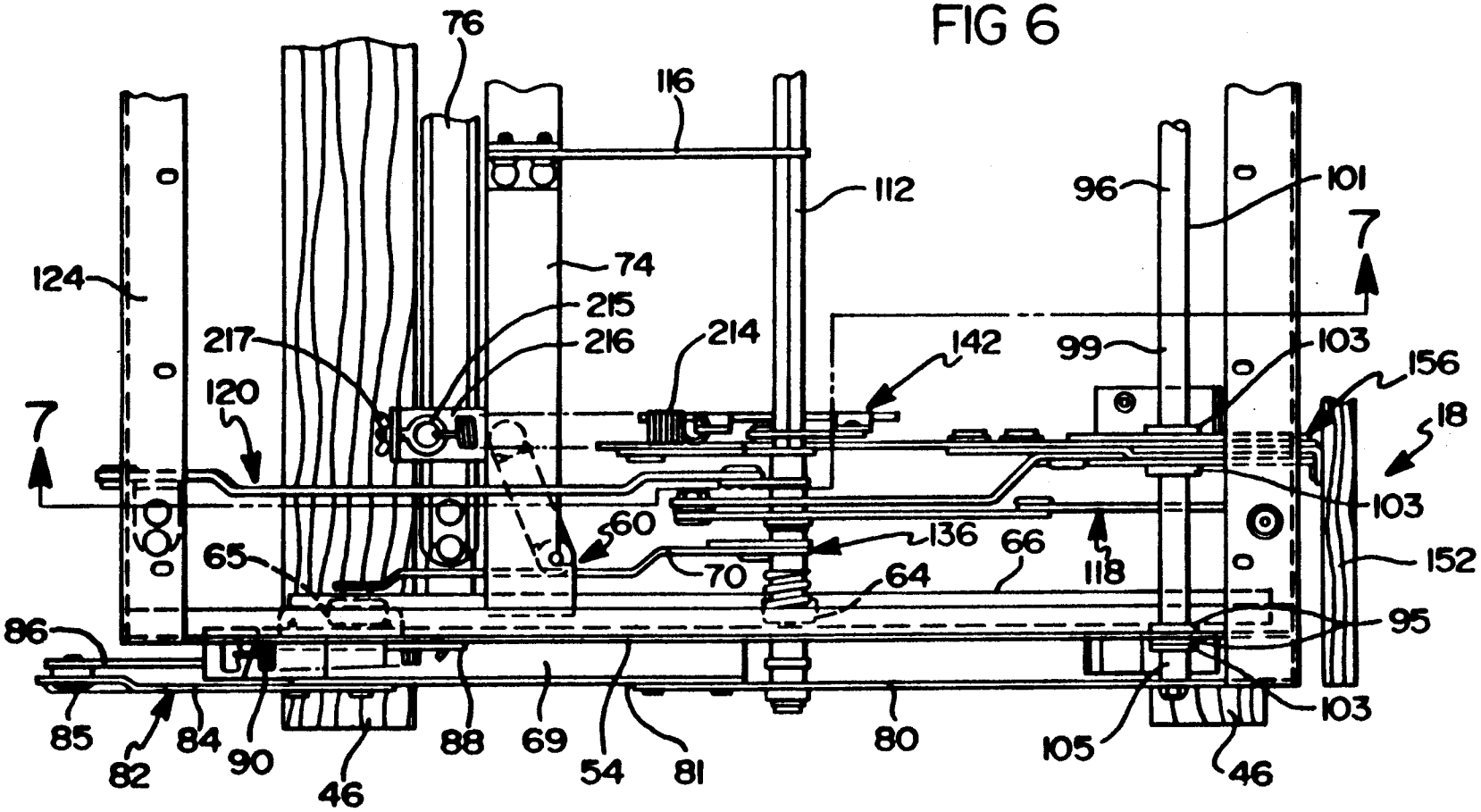
FIG. 6 is a plan view of the right half portion of the recliner mechanism FIG. 4.

With reference to FIGS. 5 and 6, nylon washers 95 are shown biased by the interaction of several components. In particular, a spring 97 is provided which concentrically surrounds support shaft 96 between right seat plate 80 and a nylon washer 95 adjacent an outer surface of slot 98 (FIG. 4). Right and left short tubular spacer sleeves 99 and a longer central spacer sleeve 101 are coaxially supported on support shaft 96 and are provided for positively locating and separating portions of pantograph leg rest linkages 156, to be described hereinafter, thereon. Wave washers 103 provide a slight side-loading on spacer sleeves 99 and 101 and washers 95 to produce a rigid support shaft 96.

Swing assemblies 82, extension springs 90 and the friction means provided on support shaft 96 coact to substantially maintain the normal included angle "A" (FIG. 7 and FIG. 8 in phantom) between seatback 52 and seat frame 54 upon "tilting" of seat assembly 50 when carriage assembly 60 is released to roll downwardly and forwardly in tracks 66 of base assembly 56. However, to permit independent "reclining" movement for increasing the included angle to a maximum of "B", swing members 86 each pivot about both pivots 85 and 87 to cause substantially synchronous rearward pivotal movement of seatback 52 and forward movement of seat frame 54.

As is apparent, recliner mechanism 10 is confined below seat frame 54 with tracks 66 being affixed directly to wooden bottom rails 46 of frame assembly 12. In this manner, an overall reduction in the height of recliner 10 permits use of loose cushions 106 (FIGS. 1 and 2) removably installed on top of seat frame 54. In addition, recliner mechanism 10 is designed to cause less upward angular movement of seat frame 54 than conventional recliners upon forward motion thereof during "tilting" and "reclining" which significantly reduces the effort required for the seat occupant to return seat assembly 50 to the upright position and return leg rest assembly 18 to the stored position.

As previously noted, the preferred embodiment includes an actuation lever 22, which is hidden from view in the space between the outside edge of a cushion 106 and the upholstered inside face of sofa 20, and which must only be rearwardly pivoted a relatively small amount (approximately between 30°–45° in the preferred embodiment) by its forwardly extending handle 24 when the seat occupant wants to release carriage assembly 60 for "tilting" seat assembly 50 and raising leg rest assembly 18. More specifically, pulling back on handle lever 24 produces corresponding angular movement (counterclockwise in the drawings) of a square cross-section transverse drive rod assembly 110 which is rotatably supported by suitable means at its opposite ends to left and right seat plates 80 of left and right side rail assemblies 62. The axis of rotation of drive rod 112 is generally parallel to the axis of rotation of front and rear wheel units 64 and 65, respectively.

According to the preferred embodiment, carriage assembly 60, leg rest assembly 18, and drive rod assembly 110 are operatively interconnected so that when one moves, all move, (i.e. rotation of drive rod 112 is accompanied by movement of carriage assembly 60 on base assembly 56 and movement of leg rest assembly 18). Once the occupant has pivoted handle 24 through an angle of about 30°–45° which, in turn, correspondingly rotates drive rod 112, the weight of the seat occupant in cooperation with the force amplification and mechanical advantage of drive rod assembly 110 act to release (i.e. unlocks) carriage assembly 60 for forward movement on base assembly 56 for smoothly an continuously driving the various linkages until seat assembly 50 is in the forward "tilted" position with leg rest 18 extended.

Angular movement of drive rod 112 about its axis results in movement of various linkage mechanisms for causing actuation of leg rest assembly 18 and "tilting" movement of seat assembly 50 by releasing carriage assembly 60 to roll in tracks 66. As will be appreciated, the various linkages are designed to only require a limited range of angular movement of drive rod 112 via limited rotation of actuation lever 22 for putting recliner mechanism 10 into operation. In addition, the weight of the seat occupant and the center of gravity of seat assembly 60 defined by the orientation of wheel units 64 and 65 disposed within tracks 66 combine to generate a forwardly directed force on carriage assembly 60 which augments the limited occupant input required for improved operation of recliner 10. In addition, over-center toggle assemblies for leg rest assembly 18 and for carriage assembly 60 are designed to selectively lock and drive seat assembly 50 and leg rest assembly 18 between their respective "upright" and "stowed" positions and their "tilted" and "extended" positions.

Actuator lever 22 and its handle 24 are pivotally supported for angular movement to one of seat plates 80 and are located slightly forward of drive rod 112. A transfer linkage 114 connects actuator lever 22 to drive rod 112 for transferring the angular movement thereto. A stabilizer rail 116 is secured between a central portion of drive rod 112 and upper reinforcement rail 74 of carriage assembly 60. Stabilizer rail 116 permits rotation of drive rod 112 while providing structural rigidity with carriage assembly 60.

With particular reference now to FIGS. 7 and 8, means are provided for releasably locking drive assembly 110 for retaining carriage assembly 60 in its rear-upright position. More particularly, on opposite sides of stabilizer rails 116 there are provided left and right base bracket linkage assemblies 118 which are interconnected between bottom rails 46 of frame assembly 12 and pantograph linkages 156 of leg rest assembly 18 for acting as an over-center mechanism for releasably "locking" carriage assembly 60 in its rear-upright position as shown in FIG. 7. Bracket linkage assembly 118 includes a bracket 240 affixed to bottom rail 46 of frame assembly 12 and a base link 242 pivotally supported thereto about pivot 244. The opposite end of base link 242 is pivotably coupled to swing link 192 about pivot point 246. A rearward portion of swing link 192 is journally supported on drive rod 112 for free angular movement relative thereto. The opposite rear end of swing link 192 is pivotally interconnected to a first end of power link 190.

In the upright-stowed position of FIG. 7, a line of action extending through drive rod 112 and pivot 244 positions pivot point 246 in an over-center orientation for inhibiting forward non-actuated movement of carriage assembly 60 and leg rest assembly 18. Upon initial angular movement of handle 24 by the seat occupant, drive rod 112 rotates to initiate protraction of pantograph linkages 156 of leg rest assembly 18 outwardly toward their extended operative position. Such actuation of pantograph linkages 156 causes power link 190 to pivotably move swing link 192 until pivot point 246 is positioned below the line of action (i.e. over-center) to release carriage assembly 60 for forward rolling movement in tracks 66 and to release leg rest assembly 18 for movement to its fully extended position. A bent-over tab 248 formed on bracket 240 is provided to engage an edge surface of base link 242 to limit the over-center location of pivot point 246 relative to the line of action as shown in FIG. 7.

A locking mechanism 120 is provided which inhibits "reclining" movement of seat assembly 50 in the "upright" position and which coacts with slots 98 for limiting the range of "reclining" movement of seat assembly 50 once it is in the "tilted" position. More specifically, locking mechanism 120 includes a lock pivot 122 secured to rear frame rail 124 of seat frame 54, a lock lever 126 pivotally supported at one end to lock pivot 122, an elongated lock arm 128 pivotally connected to the opposite end of lock lever 126 and which extends generally parallel to side rail assemblies 62. The forward end of lock arm 128 is pivotally connected to a lock link 130 which is secured for angular movement with drive rod 112. A notch 132 in the rear edge of lock lever 126 is adapted to contact rear frame rail 124 for limiting the "reclining" movement of seatback 52 when recliner mechanism 10 is in its "tilted" positions.

Figure 11A:
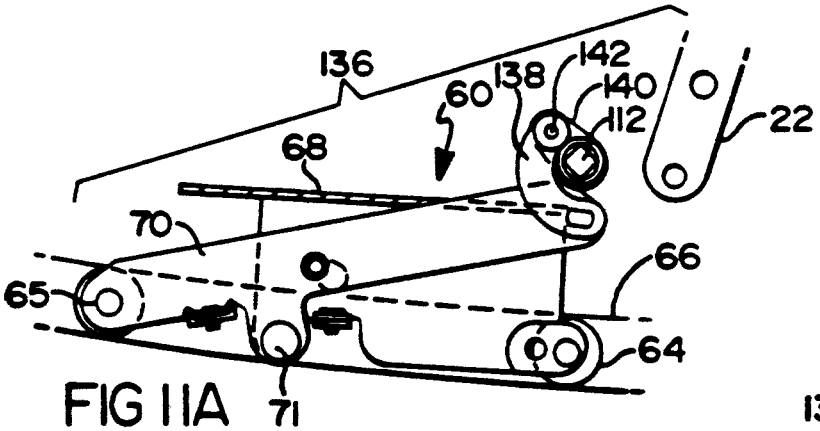
FIGS. 11A and 11B a views of the tilt linkage mechanism incorporated within the improved recliner mechanism of the present invention shown in "locked" and "released" positions, respectively.
Figure 11B:
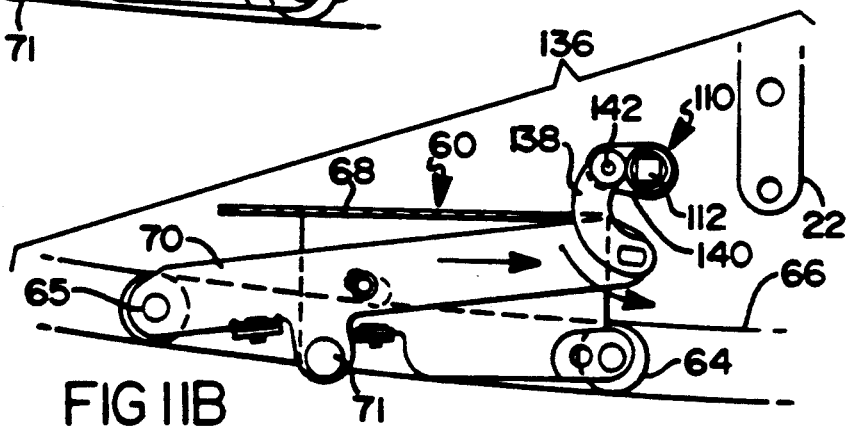

With particular reference to FIGS. 11A and 11B, drive rod assembly 110 is shown to include left and right "tilt" linkages 136 which are generally coactive with bracket linkage assemblies 118 for selectively inhibiting (i.e. locking) and permitting (i.e. releasing) forward movement of carriage assembly 60 on base assembly 56. In general, tilt linkages 136 interconnect the forward end of pivot levers 70 of carriage assembly 60 to drive rod assembly 110. More particularly, the forwardmost end of pivot levers 70 extend below and are generally aligned with the axis of drive rod 112 and are pivotally connected to a lower end of a C-shaped toggle link 138. The other end of C-shaped toggle link 138 is pivotably connected to a connector link 140 at pivot 141 and which, in turn, is secured on drive rod 112 for angular movement therewith.

When recliner mechanism 10 is in the upright position (FIG. 11A), tilt linkage assemblies 136 are inhibited against forward movement of carriage assembly 60 until actuator lever 22 and, in turn, drive rod 112 are sufficiently rotated (approximately 30°–45°) for causing bracket linkage assemblies 118 to move to the over-center position. Rotation of drive rod 112 causes corresponding rotation of connector link 140 until pivot 141 is aligned with or slightly below the rotational axis of drive rod 112 (FIG. 11B). At this point, bracket linkage assemblies 118 have gone over-center to release carriage assembly 60 such that loading acting on carriage assembly 60 (i.e. weight of occupant) and the mechanical advantage of tilt linkages 136 act to forwardly drive C-shaped toggle 138 around and below drive rod 112 so as to permit pivot levers 76 to pivot about pivot points 71 such that carriage assembly 60 is "tilted" upon forward rolling movement in tracks 66.

Tilt linkages 136 provide significant force amplification so that the force required for the occupant to pivot handle 24 is not excessive. It will be appreciated that left and right spring-assist toggle mechanisms 142 associated with operation of leg rest assembly 18 which will be hereinafter described, work coactively with bracket linkage assemblies 118 and tilt linkages 136 to smoothly and continuously drive recliner mechanism 10 for extending leg rest assembly 18 and for "tilting" seat assembly 50 in a substantially concurrent manner.

Leg rest linkage assembly 18, pantograph linkages 156, and left and right toggle mechanisms 142 are seen best in FIGS. 4, 7, and 8. These devices are similar to, but not identical with, corresponding mechanisms shown and described in the present assignee's U.S. Pat. No. 4,367,895, issued Jan. 11, 1983, entitled "Reclinable Chair" as well as its U.S. Pat. No. 3,099,487, issued Jul. 30, 1963, entitled "Leg Rest Fixture and Supplemental Holding Mechanism".

With particular reference to FIG. 7, leg rest assembly 18 is shown to include a frame board 152 having an upper surface 154 that is padded and upholstered so that in the finished sofa it will be as shown in FIGS. 1 and 2. Board 152 is supported on and moved by identical left and right hand pantograph linkages 156. Board 152 has an angled bracket 158 secured to its bottom face 160 for each pantograph 156 whereby board 152 is pivotally connected at a rear pivot 162 and a front pivot 164 to board links 166 and 168, respectively, of pantographs 156. The other end of front board link 168 is pivoted at 170 to an end of connector link 172 which is centrally pivoted at 174 to a portion of board link 166. The other end of connector link 172 is pivoted at 175 to the top of a long support link 176. The other end of rear board link 166 is pivoted at 178 to one end of a curved link 180 which is pivoted at a central pivot 182 to a central portion of long support link 176. The other end of curved link 180 is pivoted at 184 to front support shaft 96. Pivot 184 is a point of support on carriage assembly 60 for pantographs 156.

Another point of support is pivot 186 at the curved bottom end of long support link 176 which connects support link 176 to one end of drive link 188, the other end of which has a square aligned hole through which square drive rod 112 extends so that drive link 188 is generally driven by angular movement of drive rod 112. Thus, rotation of drive rod 112 turns drive link 188 which acts through pivot 186 to move long support link 176. Such movement of support link 176 causes link 180 to swing about fixed pivot 184 by virtue of pivot connection 182 that link 180 has with long support link 176. The action of link 180 swinging about fixed pivot 184 moves rear board link 166 outwardly and upwardly while pivot 175 at the top end of long support link 176 causes link 172 to swing about pivot 174 and thus front board link 168 is also moved outwardly and upwardly This extensible action takes place simultaneously with both the left hand and right hand pantographic linkage mechanisms 156 when there is sufficient angular movement of drive rod 112 to unlock toggle mechanism 142. The effect is to move frame board 152 between its stowed vertical position (FIGS. 1B, 2B and 7) and its elevated, relatively horizontal position (FIGS. 1C, 2C and 8).

Left and right power links 190 are shown to extend over drive rod 112 and are pivotally supported at their rearward end on a portion of swing links 192 mounted on drive rod 112 and at their top ends at pivots 194 located on a central portion of curved links 180. Upon swinging movement of curved links 180 in the manner previously described, power links 190 act to assist in driving pantograph linkages 156 to their extended operative position. As mentioned, power link 192 interconnects pantograph linkages 156 to bracket linkage assemblies 118.

Left and right hand spring-assist toggle assemblies 142 are provided which, as pointed out in U.S. Pat. Nos. 3,099,487 and 4,367,895, work with leg rest assembly 18. Toggle assemblies 142 provide means for holding leg rest assembly 18 tightly in a fully retracted (i.e. stowed) position against the front of the sofa frame and also provides means for supplying a spring force for driving leg rest assembly 18 to its extended position. Toggle assemblies 142 each include a toggle lever 202 with a square hole which is mounted by means of the square hole on square drive rod 112 for selective rotation therewith. Toggle lever 202 is pivotally connected at 204 to front leg 206 of a C-shaped toggle link 208 that curves around, below and to the rear of drive rod 112 where its rear leg 210 has an opening 212 in which one end of a helical coil spring 214 is hooked. The opposite end of spring 214 is hooked to an eye screw 215 threadably secured to spring bracket 216 which, in turn, is secured to upper stabilizer rail 74.

As shown in FIG. 6, a wing nut 217 is provided for adjusting the tension in spring 214. For example, the tension in spring 214 can be adjustable relieved for a lighter weight occupant or it can be increased for a heavier seat occupant. Such adjustment means provide an extra comfort and convenient feature to recliner mechanism 10. The opposite spring 214 is shown in FIG. 5 to be secured to a second bracket 219 which has stepped surface means for step-wise spring biasing adjustment similar to bracket 94.

Operation of toggle assemblies 142 will now be described in greater detail. The location of pivot 204 below drive rod 112 and the line of action of springs 214 are such in the retracted position of leg rest assembly 18 that the spring force holds or "retains" leg rest assembly 18 retracted. As leg rest 18 is initially slightly extended upon rotation of actuator lever 22 and, in turn, drive rod 112, pivot 204 moves up and over center of the drive rod axis. Once pivot 204 is over center, tension loading on springs 214 assist in drivingly rotating drive rod 112 for elevating leg rest assembly 18 as rear leg 210 of link 208 is pulled toward reinforcement rail 74. In addition, springs 214 to assist the occupant in pivoting handle 24 through the require actuation angle. Once drive rod 112 has been sufficiently pivoted through the limited actuation angle to release carriage assembly 60 (via bracket linkage assemblies 118) and leg rest assembly 18 (via toggle mechanisms 142), the weight of the seat occupant and the biasing of springs 214 rotate handle 24 to the fully pivoted and concealed position shown in FIG. 8.

Downward pressure applied manually to frame board 152 by the seat occupant serves as means to move leg rest assembly 18 back to the "stowed" position and carriage assembly 6 rearwardly for tilting seat assembly 50 to the "upright" position. Such pressure has the benefit of a long moment arm and produces a downward rearward movement of long support links 176 which act through their pivots 186 to rotate drive links 188 in a rearward direction. This causes corresponding angular movement of drive rod 112 (i.e. clockwise in the drawings). When pivot 204 is rotated over center upon continued clockwise movement o drive rod 112, C-shaped toggle links 208 and springs 214 act as locking means to solidly hold leg rest assembly 18 in its stowed position. Likewise, this same clockwise rotation of drive rod 112 causes swing links 192 and base links 242 of bracket linkage assemblies 118 to be rotated overcenter for retaining carriage assembly 60 against forward movement which, in turn, assist in retaining seat unit 16 in its "upright" position. It will be appreciated that the various linkages are designed to work substantially simultaneously and in a cumulative manner.

The relatively low input force to be exerted on frame board 152 by the occupant permits smooth retraction of recliner mechanism 10 to the conventional seating arrangement position of FIGS. 4 and 7. Likewise, toggle mechanisms 142 and tilt linkages 136 are adapted to return to their original position (FIG. 7) for assisting in locking carriage assembly 60 and leg rest assembly 18 in their respective "upright" and "stowed" positions upon rearward movement of leg rest assembly 18 to a position in close proximity to the normal "stowed" position. As will be appreciated, this "locking" position is directly related to the amount of pivotable movement of actuator lever 22 required to actuate recliner mechanism 10.

Another feature of the present invention incorporated into recliner mechanism 10 provides rigidity and support to the forward end of seat assembly 50 when retained in the "upright" position and which controls forward movement of carriage assembly 60 for supporting leg rest assembly 18 in its fully extended position. In particular, seat frame brackets 260 are affixed to front corner surfaces of seat frame 54 and are adapted to matingly contact brackets 262 supported from brackets 240 when seat assembly 50 is in its rear-upright position and a load is applied thereto. In particular, frame brackets 260 have a surface, such as a nylon insert 264, which is adapted to engage a facing insert 266 supported on bracket 262. Therefore, weight transferred downwardly onto the front of seat frame 54 is supported to inhibit "sagging" of seat assembly 50. Brackets 262 are also formed to include a vertical stop surface 268 adapted to engage a forward edge surface of brackets 69 of carriage assembly 60 when carriage assembly 60 is in its forwardmost position relative to tracks 66. This engagement provides additional support to leg rest assembly 18 through its linkages to inhibit "sagging" thereof in the extended operative position.

Thus, the invention provides a sofa construction that has a seat frame 54 and seatback 52 that move between an "upright" position (FIG. 7), a "tilted" position (FIG. 8 in phantom) and a "reclined" position (FIG. 8). Manual force, leveraged through leg rest pantographic linkages 156, is used to overcome gravity and the spring force provided within recliner mechanism 10 for smoothly and easily returning seat assembly 50 from the "tilted" to the "upright" position and leg rest assembly 18 from its extended to its stowed position.

Figure 12:
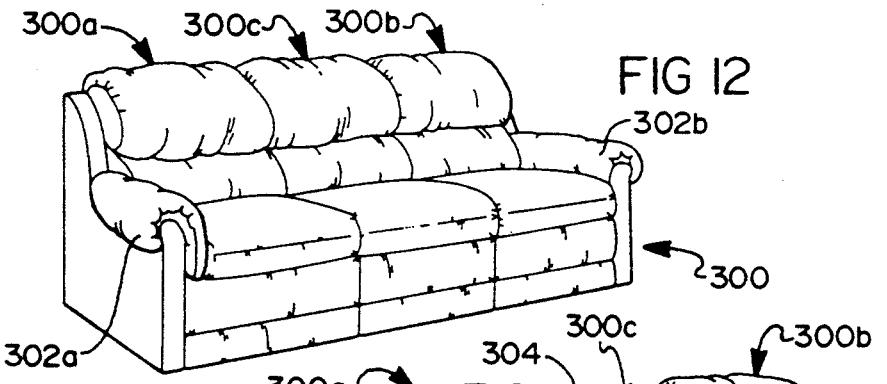
FIG. 12 an elevational view of a modular sofa having a center section which tilts and reclines.

Referring now to FIG. 12, there is shown a modular sofa 300 incorporating the recliner assist apparatus of the present invention The sofa 300 may be either a conventional sofa or of the modular type having independent seating sections releasably secured together to form a modular sofa. In either form, the sofa 300 comprises two outer seating sections **300*a* and 300*b* which each have an arm portion 302*a* and 302*b*, and a center seating section 300*c***.

Figure 13:
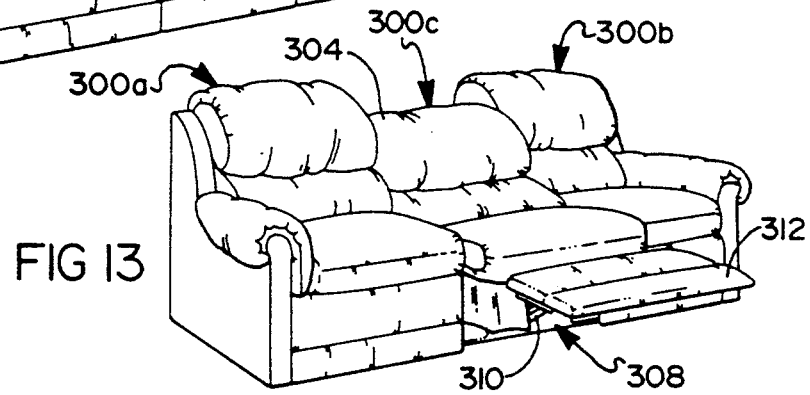
FIG. 13 is a view of the sofa of FIG. 12 showing the center seating section in a fully tilted and reclined position.

With reference to FIG. 13, the center seating section **300*c* includes a reclinable seatback portion 304 and a seat member 306. A recliner mechanism 308 including an extendable leg rest assembly 310 is disposed concealably underneath the seat member 306 for facilitating reclining movement of the seatback portion 304 in addition to extending and retracting operation of the leg rest assembly 310. Fixedly secured to a portion of the leg rest assembly 310 is a leg rest support member 312 which supports the lower legs of an occupant of the seating section 300c when the leg rest assembly 310** is in its extended position.

From FIGS. 12 and 13, it will be appreciated that the center seating section 300c, by not having any arm portions associated with it or user access to a lower side portion thereof, would otherwise, if not for the preferred embodiments of the present invention as described herein, present problems with allowing an operator to initiate reclining movement of the recliner mechanism 308 therein. By the present invention, a unique but simple apparatus is provided by which reclining action of the center seating section 300c may be initiated without the use of arm portions or manually engagable levers positioned on a lower side portion of the seating section 300c.

Figure 14:
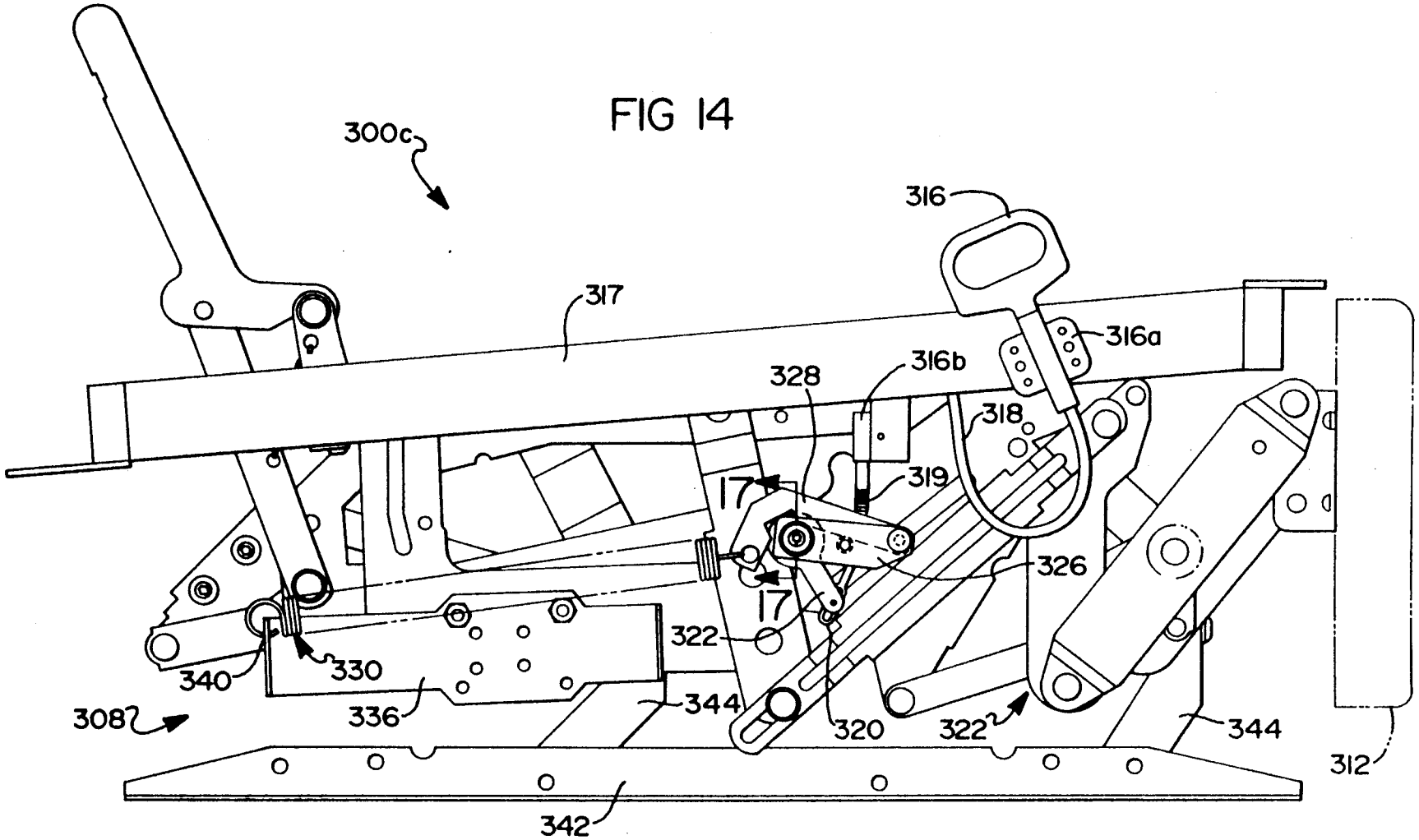
FIG. 14 is a side elevational view of a conventional two-way recliner mechanism incorporating the recliner assist apparatus of the invention.

Referring now to FIG. 14, a side elevational view of the recliner mechanism 308 is provided showing a recliner assist apparatus 314 in accordance with a preferred embodiment of the present invention. It should be appreciated immediately that the recliner mechanism 308 is a two-way recliner mechanism available under model numbers 8361 and 8290 from the Legget and Platt Company of Carthage, Missouri. It should also be appreciated, as will become more apparent from the following description, that the recliner assist apparatus 314 may be used with virtually any recliner mechanism incorporating a conventional drive rod and biasing spring which makes use of an over-center drive principle to cause reclining movement of a seatback portion of a chair and/or extending movement of a leg rest assembly. Accordingly, the entire teaching and disclosure of U.S. application Ser. No. 07/740,980, filed Aug. 6, 1991 is hereby incorporated by reference into the present application just as if same were set forth literally herein.

With further reference to FIG. 14, the recliner assist apparatus 314 includes a manually engagable release member in the form of a manually graspable handle 316 which is mounted for slidable movement by a mounting bracket 316a secured to a frame member 317 of the seating section 300c. The handle member 316 is secured to a flexible cable 318 which is held in position by a second mounting bracket 316b secured to the frame member 317. The flexible cable 318 is in turn coupled by a slotted connecting bracket 320 to a release assist bracket 322. The release assist bracket 322 is positioned for rotation concentrically about a tubular drive rod 324 (best seen in FIG. 15) of the recliner mechanism 308. A spring 319 helps bias the release assist bracket 322, and thus the handle member 316, downwardly into a retracted position.

The recliner assist apparatus 314 further includes a drive bracket 326 which is fixedly secured to the drive rod 324. An L-shaped coupling bracket 328 is pivotally coupled to the drive bracket 326 and also to a conventional biasing spring 330 of the recliner mechanism 308.

While the recliner mechanism 308 itself is a well known two-way mechanism, a brief description of some of the major components thereof, which operate in connection with the recliner assist apparatus 314, will now be provided to gain a fuller appreciation as to how the apparatus 314 operates to initiate movement of the various components of the mechanism 308. Initially, the leg rest assembly 310 includes a well known pantograph linkage assembly 332. The pantograph linkage assembly 332 is operationally coupled to the drive rod 324 and is movable from a first, or retracted, position to a second, or extended position. In the retracted position, as shown in FIG. 14, the pantograph linkage assembly 332 maintains the leg rest member 312 in a vertical position relative to a floor supporting the seating section 300c. When the seating section 300c is in its reclined position (as shown in FIG. 13), the pantograph linkage assembly 332 is in its extended position placing the leg rest member 312 in a horizontal position relative to the floor.

Figure 15:
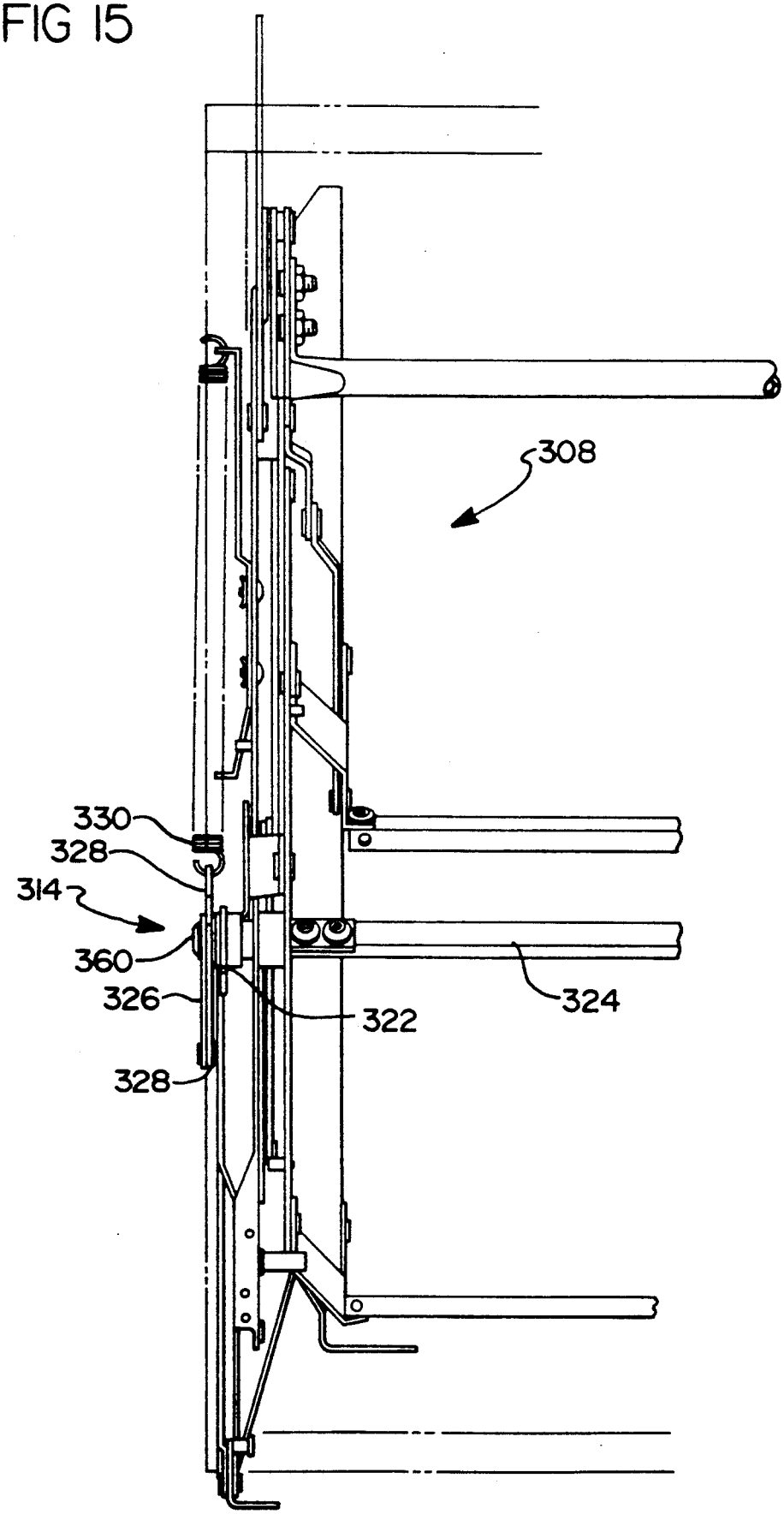
FIG. 15 is a top, fragmentary, elevational view of the recliner mechanism of FIG. 14 incorporating the apparatus of the present invention.

With continued reference to FIGS. 14 and 15, a support bracket 336 having a corner end portion 338 is included with an aperture 340 for securing a portion of the biasing spring 330 thereat. A second frame member 342 (only one of which is shown in FIGS. 14 and 15) helps support the linkage mechanism 308 above the floor via a plurality of support brackets 344.

Figure 16:
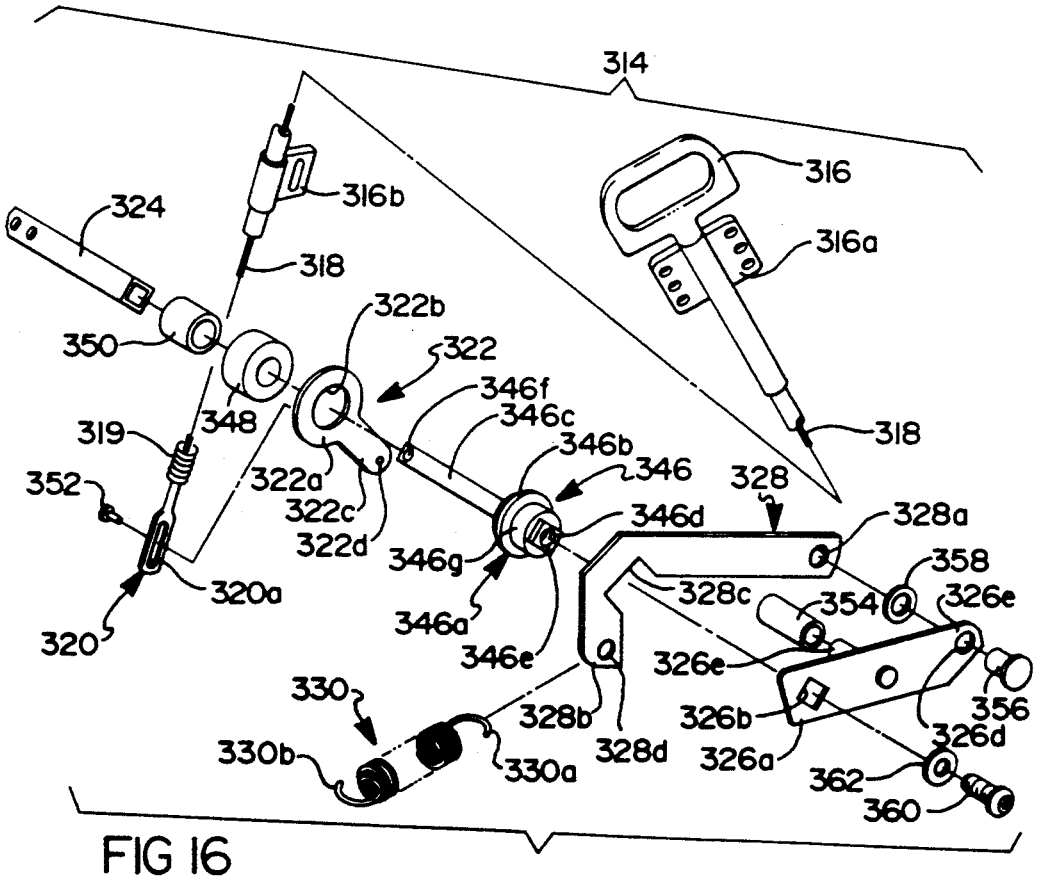
FIG. 16 is an exploded perspective view of the component parts of the recliner assist apparatus.

Referring now to FIGS. 16–18, the individual components of the recliner assist apparatus 314 are shown. The recliner assist bracket 322 includes an inner end portion 322a having a generally circular opening 322b and an outer end portion 322c having a relatively small aperture 322d. The inner end portion 322a is positioned for rotation via the circular opening 322b about a first shoulder portion 346b of an insert member 346 having a head portion 346a.

With specific reference to FIG. 16, the release assist bracket 322 is held over the first shoulder portion 346b of the insert member 346 in part by a bushing 348 which is adapted to slide over a shaft portion 346c of the insert member 346. An additional bushing 350 also is adapted to slide over a portion of the shaft portion 346c to help maintain the release assist bracket 322 over the first shoulder portion 346b of the insert member 346.

The slotted connecting bracket 320 includes an elongated, slotted portion 320a which is adapted to be pivotally secured to the outer end portion 322c of the release assist bracket 322 via a threaded screw 352. The threaded screw 352 extends through the elongated opening 320a and the aperture 322d. It will be appreciated that a rivet or any other conventional means of securing the slotted connecting bracket 320 to the release assist bracket 322 may be used, such as pop rivets, provided same allows some degree of pivotal movement between the brackets 320 and 322.

The drive bracket 326 includes an inner end portion 326a having a square shaped aperture 326b and an outer end portion 326c having a generally circular aperture 326d. A fixed post member 326e extends transversely toward the L-shaped coupling bracket 328. A spacer 354 is fixedly secured over the post 326c to extend the length of the post 326e. It will be readily appreciated, however, that a longer post 326e may be used to eliminate the need for the spacer 354 if so desired.

The outer end portion 326c of the drive bracket 326 is secured to an outer end portion 328a of the L-shaped coupling bracket 328 via a rivet 356 and washer 358. Again, a partially threaded screw may be used in lieu of rivet 356 to secure the drive bracket 326 and L-shaped coupling bracket 328 pivotally together.

The drive bracket 326 is further secured fixedly to the insert member 346 by engagement of a square shaped shoulder portion 346d thereof within the square shaped aperture 326b. A threaded locking screw 360 threadably insertable into a threaded aperture 346e and washer 362 prevent the drive bracket 326 from becoming uncoupled from the insert member 346 during operation of the recliner assist apparatus 314.

With further reference to FIG. 16, the L-shaped coupling bracket 328 further includes an inner end portion 328*b* and a cut-out portion 328*c*. The inner end portion 328*b* includes a small aperture 328*d* for allowing a first end 330*a* of the biasing spring 330 to be coupled thereto. A second end 330*b* of the biasing spring 330 may then be coupled to the support bracket 338 (FIG. 14) to enable the biasing spring 330 to exert a tensioning force on the L-shaped coupling bracket 328. The cut-out portion 328*c* allows the L-shaped coupling bracket 328 to be positioned generally over the head portion 346*a* of the insert member 346 without any interference therebetween.

The insert member 346 is secured to the drive rod 324 by inserting the shaft portion 346*c* within the drive rod 324. An aperture 346*f* in the shaft portion 346*c* allows a threaded screw or other like securing implement such as a rivet to be used to secure the insert member 346 securely to the drive rod 324. A shoulder portion 346*g* keeps the L-shaped coupling bracket 328 from being returned back too far during retraction of the pantograph linkage 332. This feature will be discussed more fully momentarily in connection with FIG. 19.

With brief reference to FIG. 17, a cross sectional view of the recliner assist apparatus 314 is shown illustrating the compactness with which the components thereof fit together. From FIG. 17 it can be seen that the recliner assist apparatus 314 forms a very compact assembly which is extremely well adapted for use with a center recliner section of a modular sofa which does not incorporate any arm portions by which reclining movement may be initiated, and where occupant access to a lever mounted on a lower side portion thereof is not possible. The overall compactness of the recliner assist apparatus 314 relative the recliner mechanism 308 is further apparent from the drawing of FIG. 15.

It should be appreciated that the insert member 346 also provides a significant advantage in that it enables the recliner assist apparatus 314 to be retroactively fitted to virtually any recliner mechanism incorporating a tubular drive rod and an over center drive mechanism. It should also be appreciated that the recliner assist apparatus 314 could just as well be used in lieu of a conventional side mounted lever which is adapted to be rotated by a seat occupant to initiate reclining movement of a recliner chair. The apparatus 314 may even be used in connection with recliner chairs having arm portions to provide an auxiliary means for initiating reclining operation. In such cases it is expected that those individuals with limited arm strength or elderly individuals might prefer to initiate reclining movement of a recliner chair via the recliner assist apparatus 314 rather than by pushing on the arm portions of the chair or by forcibly rotating a lever disposed on a side portion of the chair.

Referring now to FIGS. 19–21, a description of operation of the apparatus 314 will be provided. Referring initially to FIG. 19, the recliner assist apparatus 314 is shown in the position which it assumes when the pantograph linkage assembly 332 (FIG. 14) is in a retracted position. At this point the handle member 316 will be biased into a retracted position as shown in FIG. 19 by the biasing force of the spring 319. From FIG. 19 it can also be seen that the outer end portion 326*c* of the drive bracket is slightly "under" center, as indicated by center line 364. Thus, the biasing spring 330 exerts a tensioning force which maintains the drive bracket 326 in the orientation shown in FIG. 19, and thus the pantograph linkage assembly 332 (FIG. 14) in its retracted position. It will also be noted that a portion of the L-shaped coupling bracket 328 abuts the shoulder portion 346*g* of the insert member 346 to limit the amount of "under" center travel of the drive bracket 326 to a predetermined amount. If not for this abutting engagement, the drive bracket 326 might be driven under center slightly too far, thus making the initial assist action of the release assist bracket 322 slightly difficult.

Referring to FIG. 20, as the occupant pulls upwardly on the handle member 316, the release assist bracket 322 rotates about the insert member 346 in a counter clockwise direction such that the outer end portion 322*c* abuttingly engages the spacer 354 secured to the fixed post member 326*e* of the drive bracket 326. As the handle member 316 is pulled outwardly relative to the seat member 306, the outer end portion 326*c* of the drive bracket 326 is urged by the release assist bracket 322 into a position where the outer end portion 326*c* is slightly "over" center or, put differently, over the center line 364 as shown in FIG. 20.

At the instant the outer end portion 326*c* of the drive bracket 326 crosses the center line 364 during its counter clockwise rotational movement, the tensioning force applied by the biasing spring 330 causes the drive bracket to be rapidly driven rotationally in a counter clockwise direction to a position as shown in FIG. 21. During its counter clockwise rotational movement, the drive bracket 326, being fixed securely to the drive rod 324, causes the drive rod 324 to be driven in a counter clockwise manner concurrently therewith. The counter clockwise rotational movement of the drive rod 324 in turn causes the pantograph linkage 332 to be urged into its extended position to place the leg rest member 312 in a horizontal position relative to the floor while the seatback 304 of the seating section 300*c* is urged into a reclined position.

After the biasing spring 330 takes over to drive the pantograph linkage 332 to its extended position, the occupant may release the handle member 316. The biasing force of the spring 319 then causes the outer end portion 322*c* of the release assist bracket 322 to be driven downwardly in a clockwise direction to its original or resting position. This simultaneously causes the handle member 316 to be withdrawn to its rest position as shown in FIG. 19.

When the pantograph linkage 332 is retracted by a downward force applied by the lower legs of the occupant on the leg rest member 312, the drive bracket 326 is urged in a clockwise direction concurrently with clockwise rotational movement of the drive rod 324 as the pantograph linkage 322 is retracted. When the pantograph linkage 332 is fully retracted, the drive bracket 326 reassumes the position shown in FIG. 19.

Referring now to FIGS. 22 and 23, an alternative preferred drive bracket 366 is shown for use with a recliner assist apparatus 368 in accordance with an alternative preferred embodiment of the present invention. It should be appreciated immediately that the recliner assist apparatus 368 is identical to the recliner assist apparatus 314 with the exception that the drive bracket 366 does not require the use of an insert member such as insert member 346 of the recliner assist apparatus 314.

The drive bracket 366 includes a transversely extending corner 366*a* having an aperture 366*b* and an opening 366*c*. The aperture 366*b* allows the drive bracket 366 to be secured to a drive rod 324 when the bracket 366 is placed over an end of the drive rod 324 such that the drive rod 324 extends through the opening 366*c*, as shown in FIG. 22. A threaded screw 370, which extends through both the drive rod 324 and the corner portion 366*a* of the drive bracket 366 allows the drive bracket 366 to be secured to the drive rod 324.

It should be appreciated that the use of the drive bracket 366 somewhat simplifies the construction of the release assist apparatus 368 by not requiring the use of the insert member 346, but the use of the drive bracket 366 causes the apparatus 368 to protrude outwardly approximately about one half inch more than the apparatus 314. Thus, in applications where compactness is of crucial importance, the use of the release assist apparatus 314 may be found to be preferable.

Those skilled in the art can no appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A seating section having a recliner assist apparatus unit for use in an article of furniture of the type having a frame section within which said seating section is secured, said seating section comprising:

a seat member;

a leg rest assembly supported for movement between a retracted position and an extended position;

drive means for urging said leg rest assembly into said extended position, said drive means being movable between a locked position wherein said leg rest assembly is releasably retained in said retracted position and a released position wherein said leg rest assembly is permitted to move toward said extended position;

manually-operated recliner assist means for initiating movement of said leg rest assembly from said retracted position to said extended position, said recliner assist means including a manually engagable release member, release assist bracket means operationally coupled to said release member for moving rotationally in response to movement of said release member, and drive bracket means operationally coupled to said drive means, said drive bracket means being urged rotationally in response to movement of said release assist bracket means from a first position wherein said drive means is in said locked position toward a second position wherein said drive means is in said released position; and biasing means operationally coupled to said drive bracket means and a portion of said seating section for urging said drive bracket means towards said second position after a predetermined amount of rotational travel of said drive bracket means, and for urging said drive bracket means into said first position after a predetermined degree of travel of said leg rest assembly as said leg rest assembly is urged into said retracted position.

2. The seating section of claim 1, wherein said manually engagable release member comprises an operator pullable handle member adapted to be pulled away from said seat member of said seating unit.

3. The seating section of claim 1, wherein said drive means includes a tubular drive rod, and wherein said release assist means further comprises an insert member adapted to be inserted partially within said tubular drive rod for fixedly coupling said drive bracket means to said tubular drive rod.

4. The seating section of claim 3, wherein said release assist bracket means comprises a release assist bracket adapted to rotate about a portion of said insert member, said release bracket having an inner end portion and an outer end portion, said inner end portion being adapted to fit coaxially over said insert member and said outer end portion being operationally coupled to said release member.

5. The seating section of claim 1, wherein said drive bracket means comprises:

a drive bracket having an inner end portion and an outer end portion and a fixed post member extending generally transversely therefrom, said inner end portion being fixedly secured to said drive means;

wherein said seating section further comprises an L-shaped coupling bracket having an inner end portion and an outer end portion, said outer end portion of said L-shaped coupling bracket being pivotally coupled to said outer end portion of said drive bracket and said inner end portion of said L-shaped coupling bracket being operationally coupled to said biasing means; and said release assist bracket means being operable to abuttingly engage said fixed post member as said release member is pulled by an occupant of said seating unit to thereby cause said release assist bracket means to initiate rotational movement of said drive bracket towards said second position, said L-shaped coupling bracket causing said drive bracket to be rapidly, rotatably driven into said second position in response to a biasing force from said biasing means after said drive bracket reaches a predetermined point of rotational travel.

6. The apparatus of claim 5, wherein said release assist bracket means is coupled with said handle member via a flexible cable.

7. The apparatus of claim 6, further comprising a return spring circumscribing a portion of said flexible cable to provide a biasing force for urging said outer end portion of said release assist bracket means away from said drive bracket and for returning said release member to a retracted position relative to said seat member once said occupant releases said release member.

8. A seating unit having a recliner assist apparatus for use in an article of furniture of the type having a frame section within which said seating unit is secured, said seating unit comprising:

a seat member;

a leg rest assembly supported for movement between a retracted position and an extended position;

a drive rod operatively connected to said leg rest assembly for urging said leg rest assembly into said extended position, said drive rod being movable between a locked position wherein said leg rest assembly is releasably retained in said retracted position and a released position wherein said leg rest assembly is permitted to move toward said extended position;

a release assist bracket coaxially disposed with said drive rod and disposed for rotational movement relative to said drive rod;

a drive bracket fixedly secured to said drive rod so as to be capable of imparting rotational movement to said drive rod;

a release member manually engagable by an occupant of said seating unit, said release member being operationally coupled to said release assist bracket to cause said release bracket to move rotationally about said drive rod as said release member is engaged by said occupant;

biasing means operationally coupled to said drive bracket and a portion of said seating unit for causing said drive bracket to be urged rotationally a predetermined amount in response to rotational movement of said release bracket to thereby cause said drive rod to urge said leg rest assembly into said extended position.

9. The seating unit of claim 8, wherein said manually engagable release member comprises:

a handle member adapted to be grasped and pulled outwardly relative to said seat member of said seating unit by an occupant of said seating unit;

a flexible cable operationally coupled to said handle member;

a slotted connecting bracket fixedly secured to said flexible cable for pivotally coupling with said release assist bracket; and a return spring operationally associated with said flexible cable to cause said handle member to be urged continuously into a retracted position when said handle member is not being engaged by said occupant.

10. The seating unit of claim 8, wherein said drive rod comprises a tubular drive rod; and wherein said seating unit further comprises an insert member insertable within said tubular drive rod for fixedly securing said drive bracket to said tubular drive rod.

11. The seating unit of claim 8, wherein said biasing means comprises:

a spring having a first end and a second end, said first end being secured to a portion of said seating unit.

12. The seating unit of claim 11, further comprising an L-shaped coupling bracket having an inner end portion and an outer end portion, said outer end portion being pivotally coupled to said drive bracket and said inner end portion being coupled to said first end of said spring, said spring causing said L-shaped coupling bracket to urge said drive bracket and thereby said drive rod rotationally to thereby urge said leg rest assembly into said extended position.

13. A seating unit having a release assist apparatus, said seating unit being adapted for use in an article of furniture of the type having a frame section within which said seating unit is secured, said seating unit comprising:

a seat member;

a leg rest assembly supported for movement between a retracted position and an extended position;

drive means including a tubular drive rod for urging said leg rest assembly into said extended position, said drive means being movable between a locked position wherein said leg rest assembly is releasably retained in said retracted position and a release position wherein said leg rest assembly is permitted to move toward said extended position;

a release assist bracket having an inner end portion and an outer end portion and being disposed coaxially with said drive rod and movable rotationally relative to said drive rod;

an insert member coupleable to said tubular drive rod;

a drive bracket having an inner end portion and an outer end portion, said inner end portion being fixedly secured to said insert member, said drive bracket further having a fixed post member extending transversely therefrom;

an L-shaped coupling bracket having an inner end and an outer end, said outer end being pivotally coupled to said outer end portion of said drive bracket;

a manually engagable release member adapted to be grasped by an occupant of said seating unit and pulled outwardly away from said seat member of said seating unit by said occupant;

a flexible cable coupled to said outer end portion of said release assist bracket and to said release member for causing said release assist bracket to be moved rotationally in response to movement of said release member;

biasing means having a first end and a second end, said first end being secured to a portion of said seat assembly and said second end being secured to said inner end of said L-shaped coupling bracket;

said outer end portion of said release assist bracket further being disposed in general lateral alignment with said fixed post member such that engagement of said handle member by said seat occupant causes said outer end portion to abuttingly engage with said fixed post member, thereby urging said fixed post member rotationally into an over center position whereby said biasing means and said L-shaped coupling bracket cause said drive bracket to be driven rapidly rotationally to thereby cause said leg rest assembly to be urged into said extended position.

14. The seating unit of claim 10, wherein said inner end portion of said drive bracket includes a transversely extending corner portion for facilitating fixed securing of said drive bracket to said drive rod.

* * * * *

UNITED STATES PATENT AND TRADEMARK OFFICE

CERTIFICATE OF CORRECTION

PATENT NO. : 5,292,170

DATED : March 8, 1994

INVENTOR(S) : Larry P. LaPointe, Karl J. Komorowski, & Jonathan R. Saul.

It is certified that error appears in the above-indentified patent and that said Letters Patent is hereby corrected as shown below:

Abstract line 8,
"a" should be -- an --.

Column 1, line 41,
"full" should be -- fully --.

Column 4, line 18,
after "and" insert -- reclined --.

Column 4, line 27,
after "be" insert -- installed --.

Column 4, line 30,
after "mechanism" insert -- of Figure --.

Column 4, line 32,
after "mechanism" insert -- of --.

UNITED STATES PATENT AND TRADEMARK OFFICE

CERTIFICATE OF CORRECTION

PATENT NO. : 5,292,170

DATED : March 8, 1994

INVENTOR(S) : Larry P. LaPointe, Karl J. Komorowski, & Jonathan R. Saul.

It is certified that error appears in the above-indentified patent and that said Letters Patent is hereby corrected as shown below:

Column 4, line 39,
after "(in" insert -- phantom).

Column 4, line 45,
"a" should be -- are side --.

Column 4, line 49,
after "12" insert -- is --.

Column 4, line 50,
after "center" insert -- seating --.

Column 4, line 56,
after "the" insert -- present --.

Column 4, line 64,
after "17-17" insert -- in Figure --.

UNITED STATES PATENT AND TRADEMARK OFFICE

CERTIFICATE OF CORRECTION

PATENT NO. : 5,292,170

DATED : March 8, 1994

INVENTOR(S) : Larry P. LaPointe, Karl J. Komorowski, & Jonathan R. Saul.

It is certified that error appears in the above-indentified patent and that said Letters Patent is hereby corrected as shown below:

Column 10, line 11,
"an" should be -- and --.

Column 12, line 54,
after "upwardly" insert -- . --.

Column 13, line 59,
"6" should be -- 60 --.

Column 13, line 67,
"o" should be -- of --.

Column 19, line 20,
"no" should be -- now --.

Signed and Sealed this

Ninth Day of August, 1994

Bruce Lehman

*Attest:*

BRUCE LEHMAN

*Attesting Officer*

*Commissioner of Patents and Trademarks*